US011267109B2

(12) United States Patent
Banba et al.

(10) Patent No.: US 11,267,109 B2
(45) Date of Patent: Mar. 8, 2022

(54) ELECTRIC TOOL

(71) Applicant: TECHWAY INDUSTRIAL CO., LTD., Taichung (TW)

(72) Inventors: Tatsuo Banba, Kyoto (JP); Fu Hsiang Chung, Taichung (TW); Cheng Hung Lin, Taichung (TW)

(73) Assignee: TECHWAY INDUSTRIAL CO., LTD., Taichung (TW)

( * ) Notice: Subject to any disclaimer, the term of this patent is extended or adjusted under 35 U.S.C. 154(b) by 388 days.

(21) Appl. No.: 16/585,921

(22) Filed: Sep. 27, 2019

(65) Prior Publication Data

US 2020/0139519 A1 May 7, 2020

(30) Foreign Application Priority Data

Nov. 6, 2018 (JP) ..... JP2018-209158
Nov. 6, 2018 (JP) ..... JP2018-209159
Nov. 6, 2018 (JP) ..... JP2018-209160
Jan. 25, 2019 (JP) ..... JP2019-011381

(51) Int. Cl.
*B25B 21/00* (2006.01)
*B25F 5/02* (2006.01)

(52) U.S. Cl.
CPC ..... *B25B 21/00* (2013.01); *B25F 5/02* (2013.01)

(58) Field of Classification Search
CPC ..... B25B 21/00; B25B 21/001; B25B 21/002; B25B 21/005; B25B 21/02; B25B 13/48; B25B 13/481; B25B 13/5091; B25B 17/00; B25B 23/14; B25B 23/153; B25F 5/00; B25F 5/02; B25F 1/00; E21B 19/16
See application file for complete search history.

(56) References Cited

U.S. PATENT DOCUMENTS 6,026,910 A * 2/2000 Masterson ..... B25F 5/02 173/162.2
6,938,706 B2 * 9/2005 Ng ..... B25F 5/02 173/170
2007/0084310 A1 * 4/2007 Kobayashi ..... B25B 21/00 81/57.39
2017/0157752 A1 * 6/2017 Nishimiya ..... B25F 5/001

FOREIGN PATENT DOCUMENTS

JP S-59-42276 A 3/1984
JP 08216046 8/1996
JP 2003311655 11/2003
JP 2016010835 1/2016
JP 2016013595 1/2016

* cited by examiner

*Primary Examiner* — Robert J Scruggs
(74) *Attorney, Agent, or Firm* — Guice Patents PLLC

(57) ABSTRACT

An electric tool includes a motor section, a head section, a handle section, a coupling section, a battery, and a fragment ejecting mechanism. The head section is configured to twist off the fragment portion of a shear bolt. The coupling section detachably couples the head section to the motor section and allows the pointing direction of the front end of the head section to be changed along the radial direction of the motor shaft in the motor section. The fragment ejecting mechanism has a pushing portion and a driving portion. The pushing portion is provided in the head section and is configured to push out the twist-off fragment portion. The driving portion is provided at the coupling section and is configured to drive the pushing portion. The electric tool can twist off and then eject the fragment portion of a shear bolt even after the head section has changed direction.

23 Claims, 23 Drawing Sheets

ELECTRIC TOOL

BACKGROUND OF THE INVENTION

1. Field of the Invention

The present invention relates to an electric tool and more particularly to an electric tool for locking a tension control bolt, or shear bolt.

2. Description of the Related Art

An electric tool for locking a shear bolt generally works in the following manner. First, the tool locks a nut to the shear bolt. Then, an additional rotating force is applied to the bolt to twist off an end portion of the bolt, and then the twisted-off portion is ejected by the tool.

Currently, the fragment ejecting mechanism of such an electric tool can be classified as electromagnetic or mechanical. An electromagnetic fragment ejecting mechanism allows an electric tool using it to have a rotatable head section without incurring major alterations to the mechanical structure of the tool, wherein the rotatable head section makes it easier to carry out fastening operations in which the tool operator cannot have a straight view of the nut and the shear bolt to be fastened together.

An electromagnetic fragment ejecting mechanism, however, consumes electric energy such that an electric tool using such a mechanism does not work as long as an electric tool using a mechanical fragment ejecting mechanism, given the same battery capacity. Nevertheless, a technique for imparting rotatability to the head section of an electric tool using a mechanical fragment ejecting mechanism has yet to be developed.

BRIEF SUMMARY OF THE INVENTION

It is an objective of the present invention to provide an electric tool allows its head section to change direction and consumes less electric energy than the conventional designs.

The electric tool of the present invention can be used on a shear bolt to first lock a nut to a fastening portion of the shear bolt and then twist a fragment portion of the shear bolt off the fastening portion, the electric tool includes a motor section, a head section, a handle section, a coupling section, a battery, and a fragment ejecting mechanism;

- the motor section includes an electric motor for generating a rotating force, the electric motor has a motor shaft, which extends along a direction intersecting the direction of the rotation axis of the shear bolt;
- the head section is disposed above the motor section, has an inner socket for engaging with the fragment portion of the shear bolt, and is configured to transmit the rotating force of the electric motor to the shear bolt and thereby rotate the shear bolt;
- the handle section and the motor section are arranged in tandem in a front-rear direction, the handle section extends along the axial direction of the motor shaft and is configured to be gripped by the user;
- the coupling section is disposed between the motor section and the head section such that not only is the head section detachably coupled to the motor section, but also the pointing direction of the front end of the head section can be changed along the radial direction of the motor shaft;
- the battery provides the electricity to drive the electric motor; and

- the fragment ejecting mechanism is configured to eject the fragment portion twisted off the fastening portion of the shear bolt and has a pushing portion and a driving portion, the pushing portion is disposed in the head section and is configured to push the fragment portion out of the inner socket. The driving portion is provided at the coupling section and is configured to drive the pushing portion.

The intended effects of the present invention are as follows. The coupling section and the fragment ejecting mechanism are so designed that the pointing direction of the front end of the head section can be changed along the radial direction of the motor shaft, that the driving portion drives the pushing portion in a mechanical manner in order for the pushing portion to eject the fragment portion left in the inner socket, and that the electric tool therefore can twist off and eject the fragment portion of a shear blot even after the head section is rotated.

BRIEF DESCRIPTION OF THE SEVERAL VIEWS OF THE DRAWINGS

The foregoing and other features and effects of the present invention will be detailed below with reference to the embodiments shown in the accompanying drawings, in which.

DETAILED DESCRIPTION OF THE INVENTION

Figure 1:
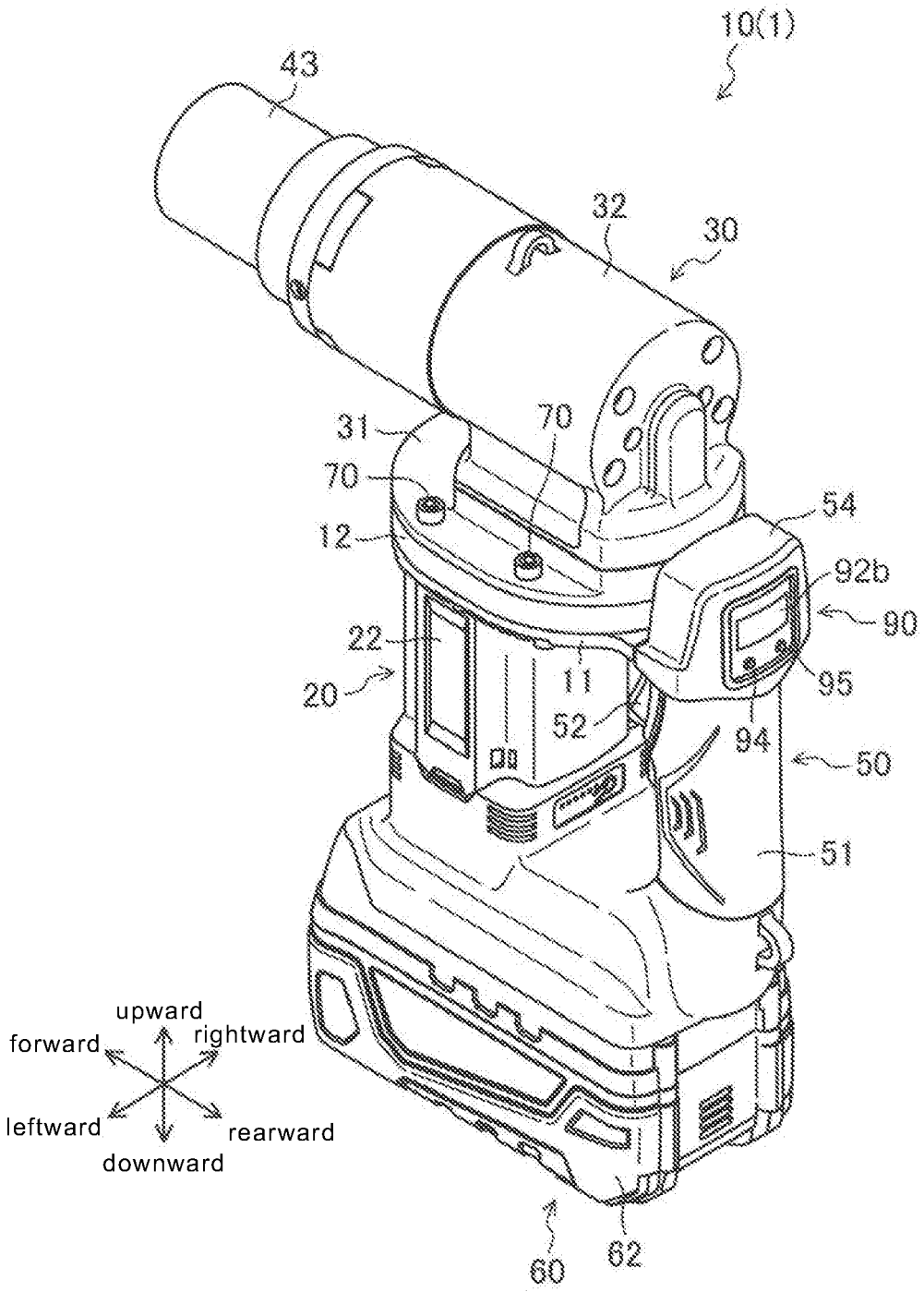
FIG. 1 is a rear perspective view of the electric tool according to an embodiment of the present invention.
Figure 2:
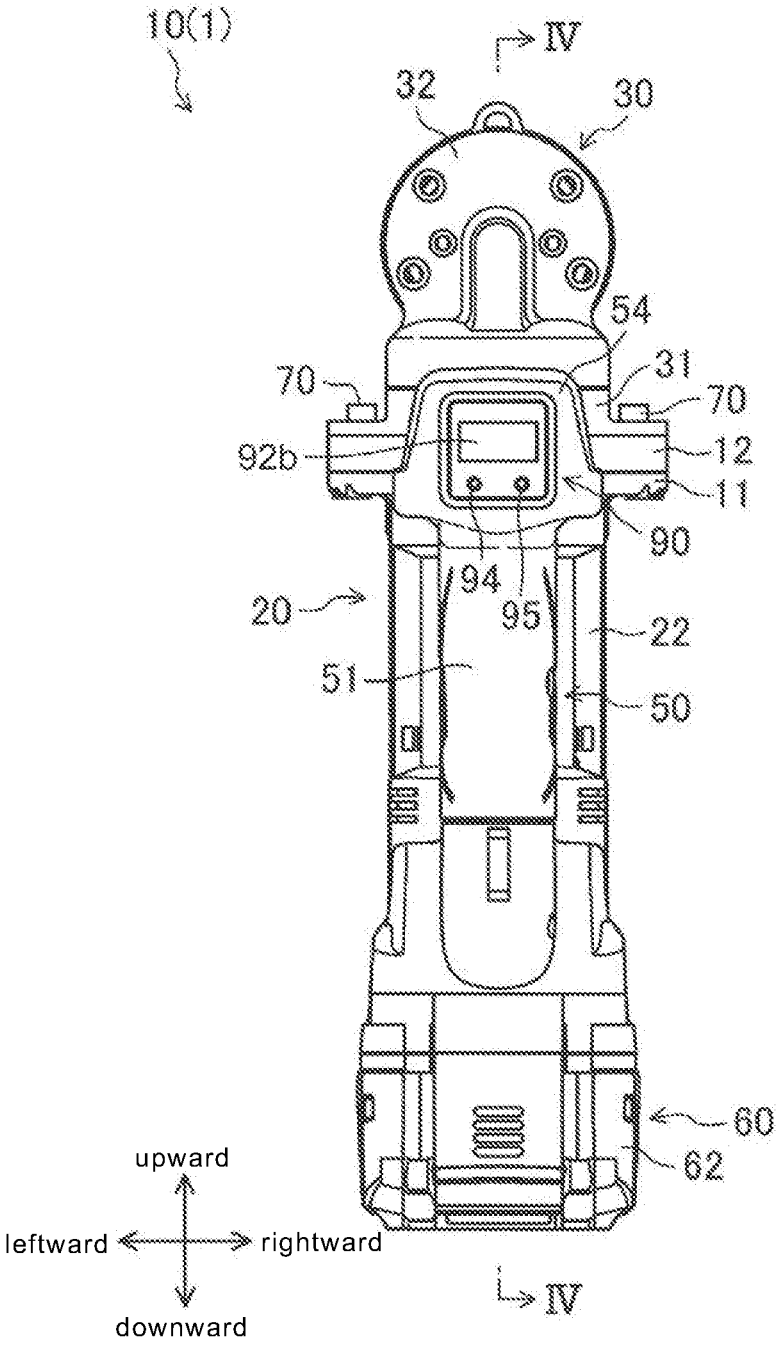
FIG. 2 is a rear view of the electric tool in FIG. 1.
Figure 4:
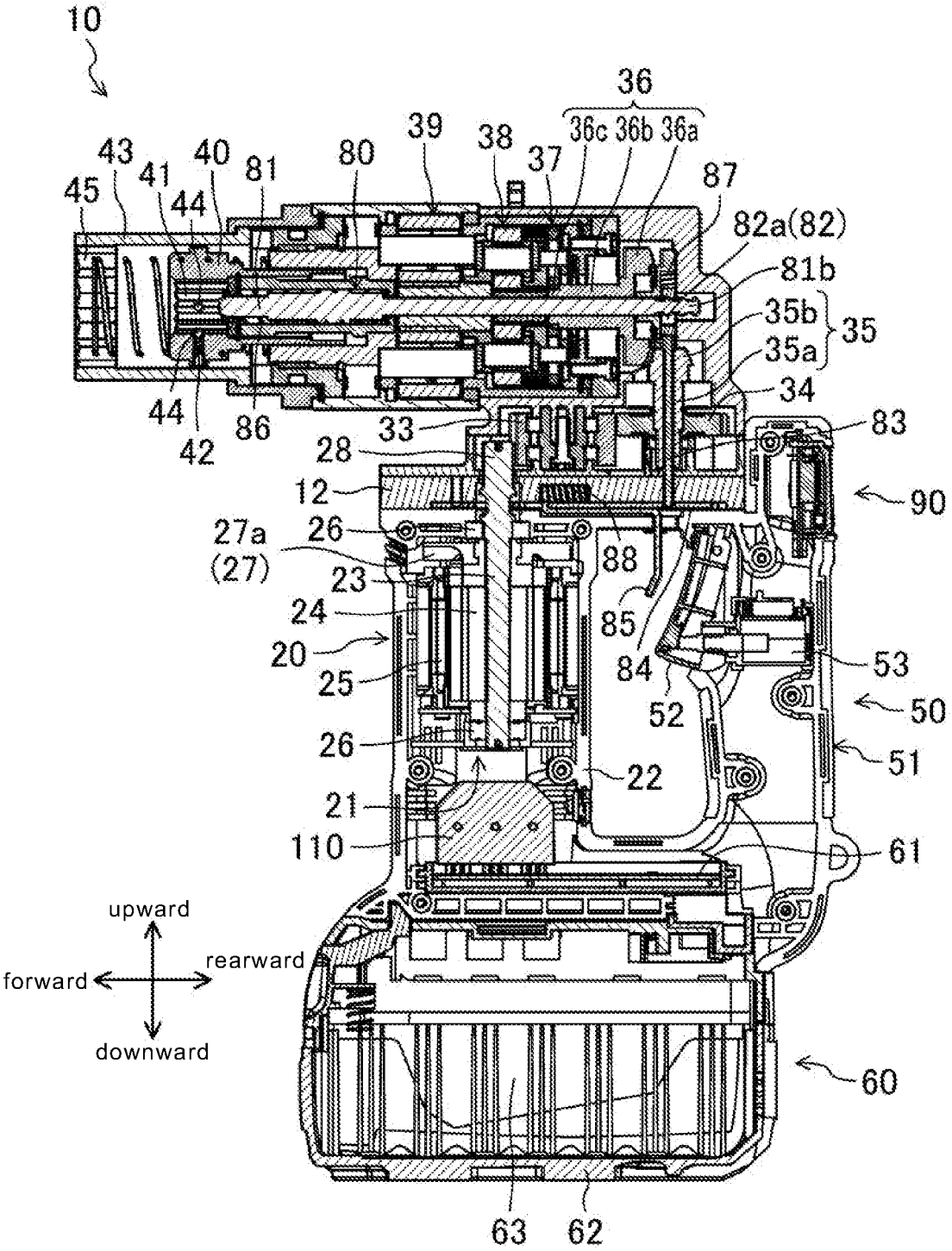
FIG. 4 is a sectional view taken along line IV-IV in FIG. 2.
Figure 5:
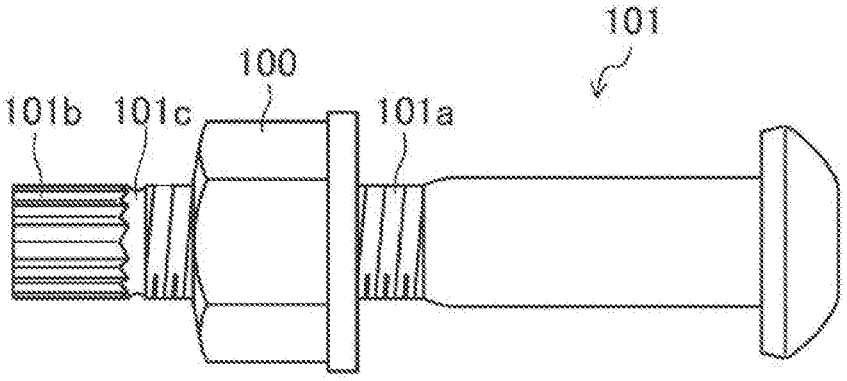
FIG. 5 schematically shows a nut and a shear bolt to be fastened together using the electric tool in FIG. 1.

Referring to FIG. 1, FIG. 4, and FIG. 5, the electric tool 1 according to an embodiment of the present invention is configured to fasten the nut 100 in FIG. 5 to the shear bolt 101, and this electric tool is also known as a twist-off type socket wrench or high-tension wrench. Herein, the forward/rearward, leftward/rightward, and upward/downward directions of the electric tool 1 are indicated by the arrows in FIG. 1, and directional expressions such as front/rear, left/right, top/bottom, upper/lower, higher/lower, above/below, up/down and vertical/horizontal are based on the aforesaid directions.

As shown in FIG. 5, the shear bolt 101 has a fastening portion 101*a*, to which the nut 100 is fastened; a fragment portion 101*b* to be engaged with the electric tool 1; and a fragile portion 101*c* provided between the fastening portion 101*a* and the fragment portion 101*b*. The electric tool 1 works in the following manner. To begin with, the electric tool 1 is engaged with the fragment portion 101*b*. Then, the electric tool 1 applies a rotating force to the nut 100 while the fragment portion 101*b* remains engaged, the objective being to fasten the nut 100 to the fastening portion 101*a*. Once the nut 100 is fastened to the fastening portion 101*a* to a certain degree, the rotating force continuously applied to the nut 100 will twist and eventually break the fragile portion 101*c* such that the fragment portion 101*b* is twisted off, i.e., separated from, the fastening portion 101*a*. Hereinafter, the term "fastening operation" refers to an operation by which the nut 100 is fastened to the fastening portion 101*a* of the shear bolt 101 and which is concluded by twisting the fragment portion 101*b* off the fastening portion 101*a*.

The electric tool 1 includes a tool body 10 with a motor section 20. An electric motor 21 is installed in the motor section 20 and serves as a source of driving power. The tool body 10 also has a head section 30 for transmitting the rotating force of the electric motor 21 to, and thereby rotating, the nut 100 and the shear bolt 101. The tool body 10 further has a handle section 50 to be gripped by the user. The handle section 50 is lower than the head section 30 and extends in a direction that intersects the extending direction of the head section 30 (i.e., the direction of the rotation axis of the nut 100). The tool body 10 is mounted with a battery 60 below the handle section 50, in order for the battery 60 to provide the electricity required to drive the electric motor 21.

The motor section 20 has a motor housing 22 extending in a up and down direction. The electric motor 21, as shown in FIG. 4, is located in the motor housing 22 and has a motor shaft 23 extending in a up and down direction. The motor shaft 23 extends in a direction that, during a fastening operation, intersects the direction of the rotation axis of the shear bolt 101.

The electric motor 21 has a rotor 24 fixed on the motor shaft 23 and a stator 25 surrounding the rotor 24. The motor shaft 23 is rotatably supported by two bearings 26, or more particularly an upper bearing 26 and a lower bearing 26. The operation of the electric motor 21 is controlled by a control unit 110, and the electric motor 21 is connected to the battery 60 (or the battery body 63 to be exact) through a connecting circuit 61.

The tool body 10 is described in more detail below with reference to FIG. 3, FIG. 4, FIG. 5, and FIG. 6. In the tool body 10, the motor housing 22 has an upper portion disposed with a head section carrying portion 11. The head section carrying portion 11 extends to the handle section 50 from the rear side of the motor housing 22 and carries the head section 30 via a coupling section 12 disposed between the head section carrying portion 11 and the head section 30 to ensure stability of the head section 30. The coupling section 12 also couples the head section 30 to the motor section 20. A lower portion of the head section 30 is configured as a head section connecting base 31 to be carried by the coupling section 12. The head section connecting base 31 is provided with a plurality of (four as in this embodiment) holes 31*a*. A plurality of threaded elements 70 are passed through the holes 31*a* respectively and then affixed respectively to either a plurality of first threaded holes 13*a* or a plurality of second threaded holes 13*b* of the coupling section 12 to affix the head section connecting base 31 to the coupling section 12. The coupling section 12 is affixed to the head section carrying portion 11 by a plurality of threaded elements 71 (see FIG. 10).

The head section carrying portion 11 has a portion corresponding to the motor shaft 23 and provided with a through bore. The coupling section 12 also has a portion corresponding to the motor shaft 23 and provided with a through bore. The through bores communicate with each other in a up and down direction. The upper end of the motor shaft 23 extends through the through bores and juts out of the upper surface of the coupling section 12.

The head section 30 has a head section housing 32, in which a transmission mechanism for transmitting the rotating force of the electric motor 21 to the nut 100 is provided. More specifically, referring to FIG. 4, the upper end of the motor shaft 23 of the electric motor 21 forms a pinion gear 28; the pinion gear 28 meshes with a first intermediate gear 33 in the head section housing 32; the first intermediate gear 33 meshes with a second intermediate gear 34, whose rotating shaft is integrated, and therefore coaxial, with the shaft portion 35*a* of a third intermediate gear 35; and the upper end of the third intermediate gear 35 forms a bevel gear 35*b* meshing with a bevel gear 36*a* at the rear end of a fourth intermediate gear 36 such that the rotating force transmitted from the motor shaft 23 is changed from rotating about a vertical axis (e.g., an axis in the up and down direction) to rotating about a horizontal axis (e.g., an axis in the front-rear direction).

The bevel gear 36*a* at the rear end of the fourth intermediate gear 36 has a forwardly extending input shaft 36*b*. The front end of the input shaft 36*b* is provided with a sun gear 36*c*, which meshes with a first planetary gear train 37. The rotating force transmitted to the first planetary gear train 37 will be transmitted to a second planetary gear train 38 on the front side of the first planetary gear train 37, then to a third planetary gear train 39 on the front side of the second planetary gear train 38, and then to an outer socket 43 configured to engage with the nut 100, in order to rotate the outer socket 43 and hence the nut 100 engaged with the outer socket 43. Thus, the rotating force of the electric motor 21 is transmitted through the transmission mechanism to the nut 100. The central axes of the bevel gear 36*a* and the first to the third planetary gear trains 37~39 and the rotation axis of the outer socket 43 coincide with one another. The front end of the outer socket 43 has an inner periphery provided with a nut engaging portion 45 for engaging with the nut 100.

An inner socket 40 is disposed in the outer socket 43. The inner socket 40 does not rotate when the outer socket 43 is rotated. The inner periphery of the inner socket 40 is provided with a fragment engaging portion 41 for engaging with the fragment portion 101*b* of the shear bolt 101. The fragment engaging portion 41 is provided with a fragment fixing mechanism that, as shown schematically in the drawings, is composed of at least one spring component 42 and at least one stainless-steel ball 44. The spring component 42 has a spring axis extending in a radial direction of the inner socket 40, and the stainless-steel ball 44 is provided at the inner end of the spring component 42. When the fragment portion 101*b* is engaged with the fragment engaging portion 41, the stainless-steel ball 44 is pushed against the fragment portion 101*b* by the elastic energy of the spring component 42; as a result, the fragment portion 101*b* is fixed in the inner socket 40 and kept from moving.

Thus, with the shear bolt 101 secured in place by the inner socket 40, the outer socket 43 can rotate the nut 100 engaged therewith to fasten the nut 100 to the shear bolt 101. During the fastening process, the fragment portion 101*b* is still secured in the inner socket 40 against rotation, so the fastening portion 101*a* and the fragment portion 101*b* are subjected to torques that act in opposite directions, with the resulting stress concentrated at a relatively weak portion (i.e., the fragile portion 101*c*) of the shear bolt 101.

Once the nut 100 and the shear bolt 101 are fastened to a certain degree, rotating the nut 100 further via the outer socket 43 will cause the inner socket 40 to apply an additional counter torque to the fragment portion 101*b* in response to the torque applied to the outer socket 43, and the fragment portion 101*b* is twisted off the fastening portion 101*a* when the fragile portion 101*c* breaks under the concentrated torsional stress. The fastening operation described above fastens the nut 100 and the shear bolt 101 securely together, leaving the twisted-off fragment portion 101*b* in the inner socket 40.

Figure 3:
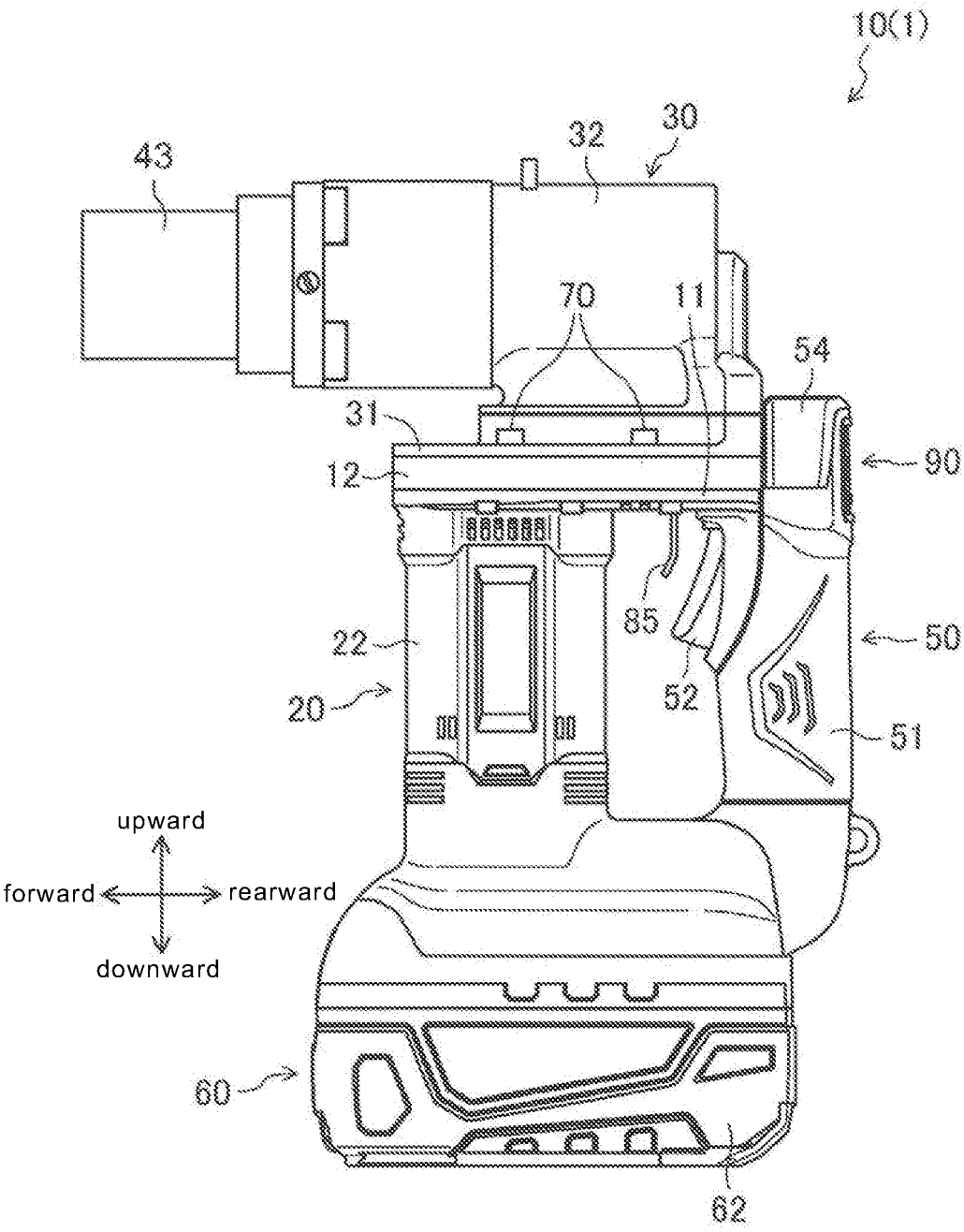
FIG. 3 is a side view of the electric tool in FIG. 1.

Referring to FIG. 1, FIG. 3, and FIG. 4, the handle section 50 extends in a direction that intersects the direction of the rotation axis of the shear bolt 101, i.e., in a up and down direction. The handle section 50 is disposed in the tool body 10 at a position rearward of the motor section 20, and the rear end of the handle section 50 is located rearward of the rear end of the head section 30. An upwardly extending mounting portion 54 is provided between the rear end of the handle section 50 and the rear end of the head section 30. The upwardly extending mounting portion 54 extends upward from an upper end of the handle section 50 and is integrally formed with the handle section 50.

The handle section 50 has a grip area 51, which is the portion actually grasped by the user. The length in a up and down direction of the handle section 50 is so designed that the user can grasp not only the grip area 51, but also a portion of the handle section 50 that is higher than the grip area 51.

An upper front portion of the handle section 50 is provided with an operation lever 52 to be operated by the user. The operation lever 52 is coupled to an operation switch 53 in the handle section 50. When the user pulls the operation lever 52 rearward (i.e., presses the operation lever 52), an activating signal is sent to the control unit 110 in order for the control unit 110 to activate the electric motor 21 and in turn for the electric motor 21 to rotate the outer socket 43. The operation switch 53 is configured to send the activating signal to the control unit 110 persistently while the operation lever 52 is being pressed, and to stop sending the activating signal when the operation lever 52 is released. Therefore, the electric motor 21 will keep rotating as long as the user is pressing the operation lever 52 and will stop rotating as soon as the operation lever 52 is released.

Referring to FIG. 1 to FIG. 4, the battery 60 is mounted below the motor section 20 and the handle section 50 of the tool body 10. The battery 60 has a battery housing 62 in addition to the battery body 63, which is disposed in the battery housing 62 and stores electricity. When the battery 60 is mounted on the tool body 10, the terminals of the battery body 63 are electrically connected to the connecting circuit 61 so that the electricity stored in the battery body 63 can be supplied to the electric motor 21.

In this embodiment, the upwardly extending mounting portion 54 is provided with a display device 90 for displaying the information of a fastening operation. The display device 90 will be detailed further below.

In this embodiment, the head section 30 can be detached from the coupling section 12, and the pointing direction of the front end of the head section 30 can be changed with respect to the motor section 20 and the handle section 50 along the radial direction of the motor shaft 23. More specifically, referring to FIG. 6, the head section 30 can be taken off the coupling section 12, and hence off the motor section 20 and the handle section 50, after the threaded elements 70 are removed from the coupling section 12. Once the orientation of the head section 30 is changed, referring to FIG. 6 and FIG. 7, the threaded elements 70 are affixed to the coupling section 12 again.

In this embodiment, the head section 30 can be affixed to the coupling section 12 to assume any of the following positions: a forward-facing position, where the front end of the head section 30 points forward (see FIG. 1); a rearward-facing position, where the front end of the head section 30 points rearward (not shown); a leftward-facing position, where the front end of the head section 30 points leftward such that the rotation axis of the inner socket 40 is perpendicular to the front-rear direction (see FIG. 7); and a rightward-facing position, where the front end of the head section 30 points rightward such that the rotation axis of the inner socket 40 is perpendicular to the front-rear direction (not shown). In other words, if the forward-facing position is defined as 0° and leftward rotation from the forward-facing position (in top view) is defined as positive rotation, the head section 30 in this embodiment can be rotated along the radial direction of the motor shaft 23 to 90° (i.e., the leftward-facing position), 180° (i.e., the rearward-facing position), and 270° (i.e., the rightward-facing position).

The coupling section 12 has four first threaded holes 13*a* and four second threaded holes 13*b*. The first threaded holes 13*a* correspond respectively in position to the holes 31*a* of the head section connecting base 31 when the head section 30 is in the forward-facing position or the rearward-facing position. The second threaded holes 13*b* correspond respectively in position to the holes 31*a* of the head section connecting base 31 when the head section 30 is in the leftward-facing position or the rightward-facing position. Thus, even after the pointing direction of the front end of the head section 30 is changed with respect to the motor section 20 and the handle section 50 along the radial direction of the motor shaft 23, the electric tool 1 according to this embodiment can still have the head section 30 detachably coupled to the motor section 20 and the handle section 50 via the coupling section 12.

Referring to FIG. 5, FIG. 6, FIG. 8, and FIG. 9, the head section connecting base 31 is provided with a plurality of (four as in this embodiment) motor through holes 31*b* so that when the head section 30 assumes any of the aforesaid positions, the pinion gear 28 on the motor shaft 23 can enter the head section 30 through the corresponding motor through hole 31*b*. As the first intermediate gear 33 partially overlaps each motor through hole 31*b*, the pinion gear 28 will mesh with the first intermediate gear 33 regardless of the motor through hole 31*b* through which the pinion gear 28 extends. Thus, the electric tool 1 according to this embodiment allows the rotating force of the electric motor 21 (see FIG. 4) to be transmitted to the inner socket 40 even after the pointing direction of the front end of the head section 30 is changed with respect to the motor section 20 and the handle section 50 along the radial direction of the motor shaft 23.

As will be detailed further below, the head section connecting base 31 is provided with a head section through holes 31*c* through which the coupling rod 83 of a fragment ejecting mechanism 80 extends, and the coupling section 12 is provided with a plurality of (four as in this embodiment) through holes 14 through any of which the coupling rod 83 of the fragment ejecting mechanism 80 can extend, and which are so located that there will always be one through hole 14 corresponding to the coupling rod 83 after the pointing direction of the front end of the head section 30 is changed.

In this embodiment, the fragment ejecting mechanism 80 of the electric tool 1 is configured to eject the fragment portion 101*b* twisted off the fastening portion 101*a* and left in the inner socket 40, regardless of the change of the pointing direction of the front end of the head section 30 with respect to the motor section 20 along the radial direction of the motor shaft 23. The fragment ejecting mechanism 80 has a pushing portion 80*a* and a driving portion 80*b*. The pushing portion 80*a* is disposed in the head section 30 and is configured to push the fragment portion 101*b* out of the inner socket 40. The driving portion 80*b* is disposed at the coupling section 12 and is configured to drive the pushing portion 80*a*. The fragment ejecting mechanism 80 further has the coupling rod 83, by which the pushing portion 80*a* and the driving portion 80*b* are mechanically linked.

The pushing portion 80*a* has a fragment rod 81. The fragment rod 81 extends along the direction of the rotation axis of the inner socket 40 (i.e., the axial direction of the inner socket 40) and can be moved along the same direction between a receiving position, where the fragment portion 101*b* is received in the inner socket 40, and an ejecting position, where the fragment portion 101*b* is ejected out of the inner socket 40. The pushing portion 80*a* further has a first spring 86 (i.e., a first elastic element) for applying the elastic energy stored therein to the fragment rod 81 and thereby driving the fragment rod 81 toward the ejecting position. The pushing portion 80*a* also has a stopper 82. When the fragment rod 81 is at the receiving position, the stopper 82 is engaged with the fragment rod 81 to prevent the fragment rod 81 from moving toward the ejecting position. The driving portion 80*b* has a sliding element 84, and the lower end (i.e., the coupling-rod engaging portion 83*a* described further below) of the coupling rod 83 abuts against the sliding element 84 so that when the sliding element 84 is horizontally slid, the coupling rod 83 is moved in a direction that intersects the direction of the rotation axis of the inner socket 40. The driving portion 80*b* further has an operating member 85 for sliding the sliding element 84.

Figure 9:
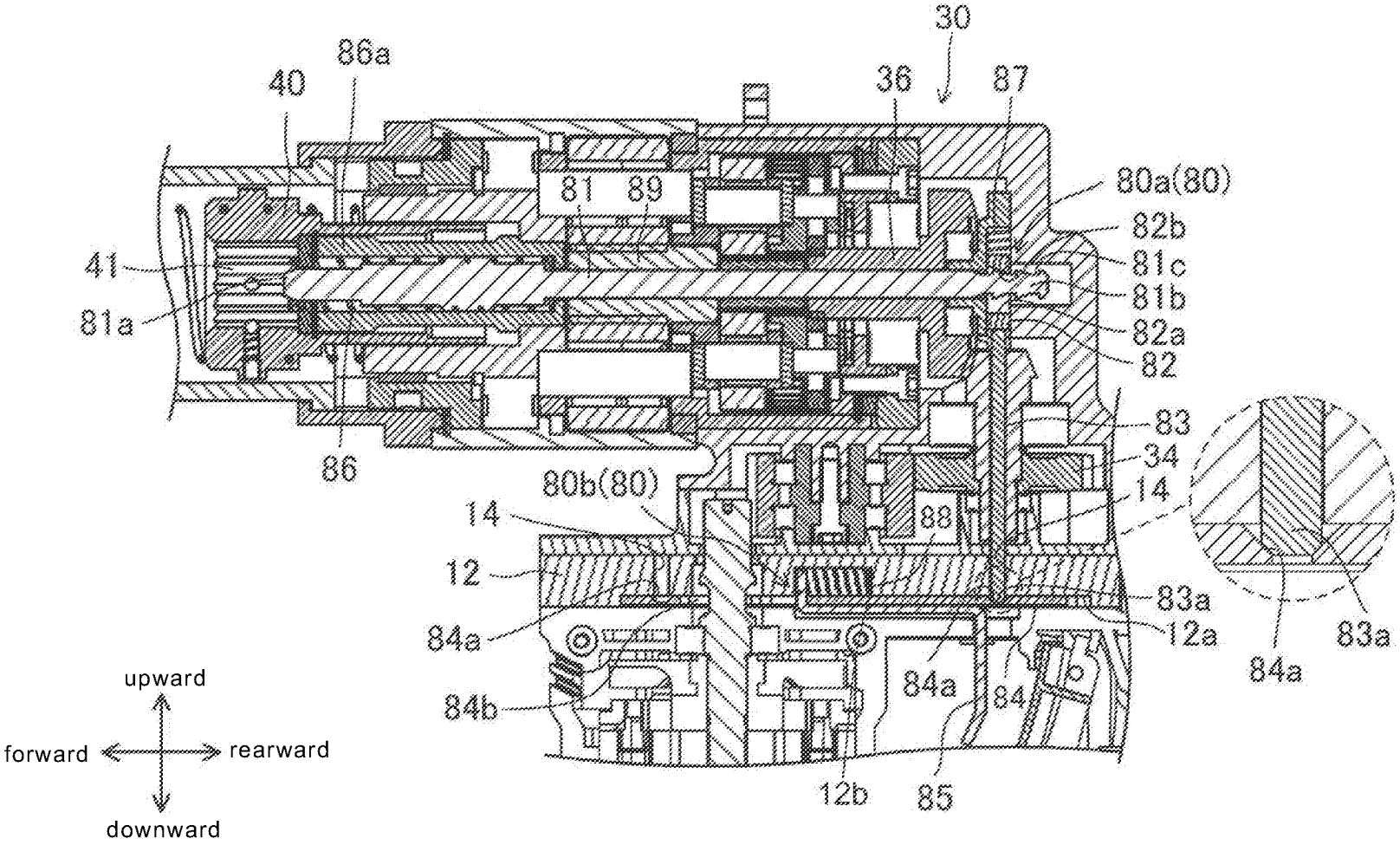
FIG. 9 is a partial enlarged view of FIG. 4, showing in particular the engagement between the coupling rod and the sliding element of the electric tool in FIG. 1.

FIG. 9 shows the fragment rod 81 at the receiving position. The fragment rod 81 extends straight in the direction of the rotation axis of the inner socket 40, with the central axis of the fragment rod 81 coinciding with the rotation axis of the inner socket 40. The fragment rod 81 has a middle portion extending through the fourth intermediate gear 36 and a guiding element 89. The front end of the fragment rod 81 forms a contact portion 81*a* for contact with the fragment portion 101*b*. When the fragment rod 81 is at the receiving position, only the front end of the contact portion 81*a* is in the inner socket 40.

The first spring 86 is disposed around the fragment rod 81 and has a spring axis coinciding with the rotation axis of the inner socket 40. The first spring 86 as well as a portion of the fragment rod 81 that lies on the same side as the inner socket 40 (hereinafter referred to as the socket side) is disposed in a spring box 86*a*. The first spring 86 has one end fixed to the spring box 86*a* and the opposite end fixed to the fragment rod 81. When the fragment portion 101*b* of the shear bolt 101 is inserted into the inner socket 40 and thus moves the fragment rod 81 to the receiving position, the first spring 86 applies the elastic energy stored therein to the fragment rod 81 along the direction of the rotation axis of the inner socket 40 in order to drive the fragment rod 81 toward the ejecting position.

The end of the fragment rod 81 that is on the opposite side of the socket side forms a to-be-stopped portion 81*b* to be stopped by the stopper 82. The to-be-stopped portion 81*b* is shaped as at least one truncated cone that is gradually reduced in diameter toward the rear side and is arranged along the axial direction of the fragment rod 81. The side of the truncated cone that is on the opposite side of the socket side forms a planar portion 81*c* that extends in the radial direction of the fragment rod 81.

The stopper 82 has an engaging hole 82*a* for engaging with the to-be-stopped portion 81*b* of the fragment rod 81. As shown in FIG. 9, an upper portion of the engaging hole 82*a* forms an inclined surface 82*b* that is gradually lowered toward the rear side to match the inclined periphery of the truncated cone of the to-be-stopped portion 81*b*. The upper side of the stopper 82 is provided with a second spring 87 (i.e., a second elastic element) for applying the elastic energy stored therein to the stopper 82 and thereby driving the stopper 82 downward, the objective being to push the inclined surface 82*b* of the engaging hole 82*a* toward the to-be-stopped portion 81*b* of the fragment rod 81 so that, even though the fragment rod 81 is driven toward the ejecting position by the elastic energy applied by the first spring 86, the to-be-stopped portion 81*b* will be stopped by the stopper 82 and thus prevent the fragment rod 81 from moving toward the socket side. Hereinafter, the state in which the stopper 82 is engaged with the fragment rod 81 and thereby prevents the fragment rod 81 from moving toward the socket side is referred to as the restrained state, and the state in which the stopper 82 is not engaged with the fragment rod 81 and therefore allows the fragment rod 81 to be moved toward the socket side is referred to as the released state.

Figure 10:
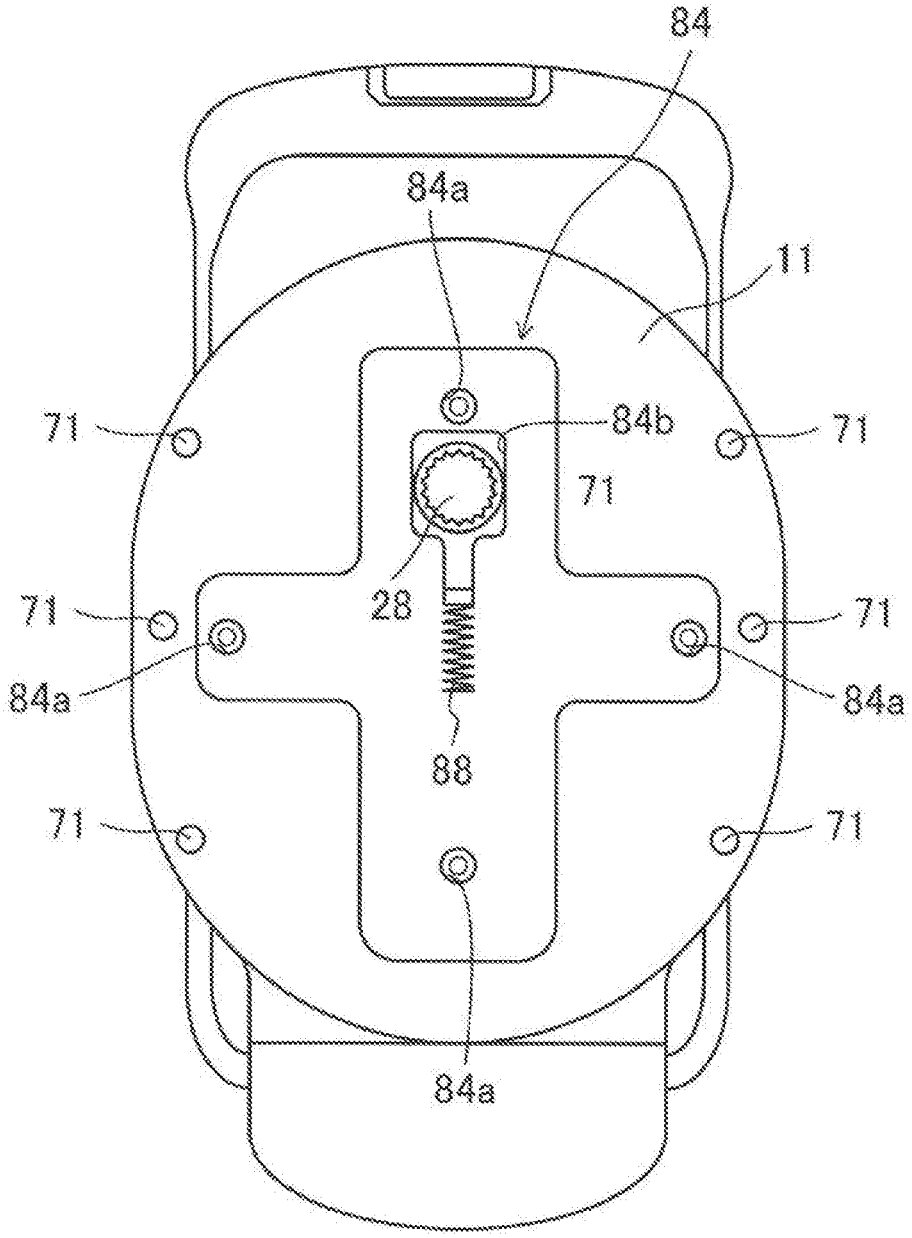
FIG. 10 is a top view of the sliding element of the electric tool in FIG. 1.

Referring to FIG. 9 and FIG. 10, the sliding element 84 is disposed in a recess 12*a* in a lower-side portion of the coupling section 12 and is in the shape of a cross when viewed in the axial direction of the motor shaft 23, wherein the four arms of the cross extend forward, rearward, leftward, and rightward respectively. The portion of the sliding element 84 that corresponds to the pinion gear 28 is provided with a motor shaft insertion hole 84*b* through which the pinion gear 28 can be inserted.

The front, rear, left, and right ends of the sliding element 84 are respectively provided with four sliding-element engaging portions 84*a* for engaging with the coupling-rod engaging portion 83*a* at the lower end of the coupling rod 83. The sliding-element engaging portions 84*a* are located in such a way that the coupling-rod engaging portion 83*a* can engage with the corresponding sliding-element engaging portion 84*a* when the operating member 85 is not operated; in other words, the sliding-element engaging portions 84*a* are so located that there will always be one sliding-element engaging portion 84*a* corresponding to the coupling rod 83 after the pointing direction of the front end of the head section 30 is changed. Each sliding-element engaging portion 84*a* is in the form of a hole and, as shown in FIG. 9, has a tapered periphery whose diameter is reduced downward.

The sliding element 84 is joined to the operating member 85. The front end of the operating member 85 extends upward into a groove 12*b* in the coupling section 12. Disposed in the groove 12*b* is a third spring 88 for applying the elastic energy stored therein to the operating member 85 and thereby driving the operating member 85, and hence the sliding element 84, forward.

The coupling rod 83 extends in a up and down direction, is passed through one of the through holes 14 of the coupling section 12, and penetrates the second intermediate gear 34. The upper end of the coupling rod 83 abuts against a lower side of the stopper 82. The periphery of the coupling-rod engaging portion 83*a* of the coupling rod 83 is tapered to match the tapered periphery of each sliding-element engaging portion 84*a*.

Figure 6:
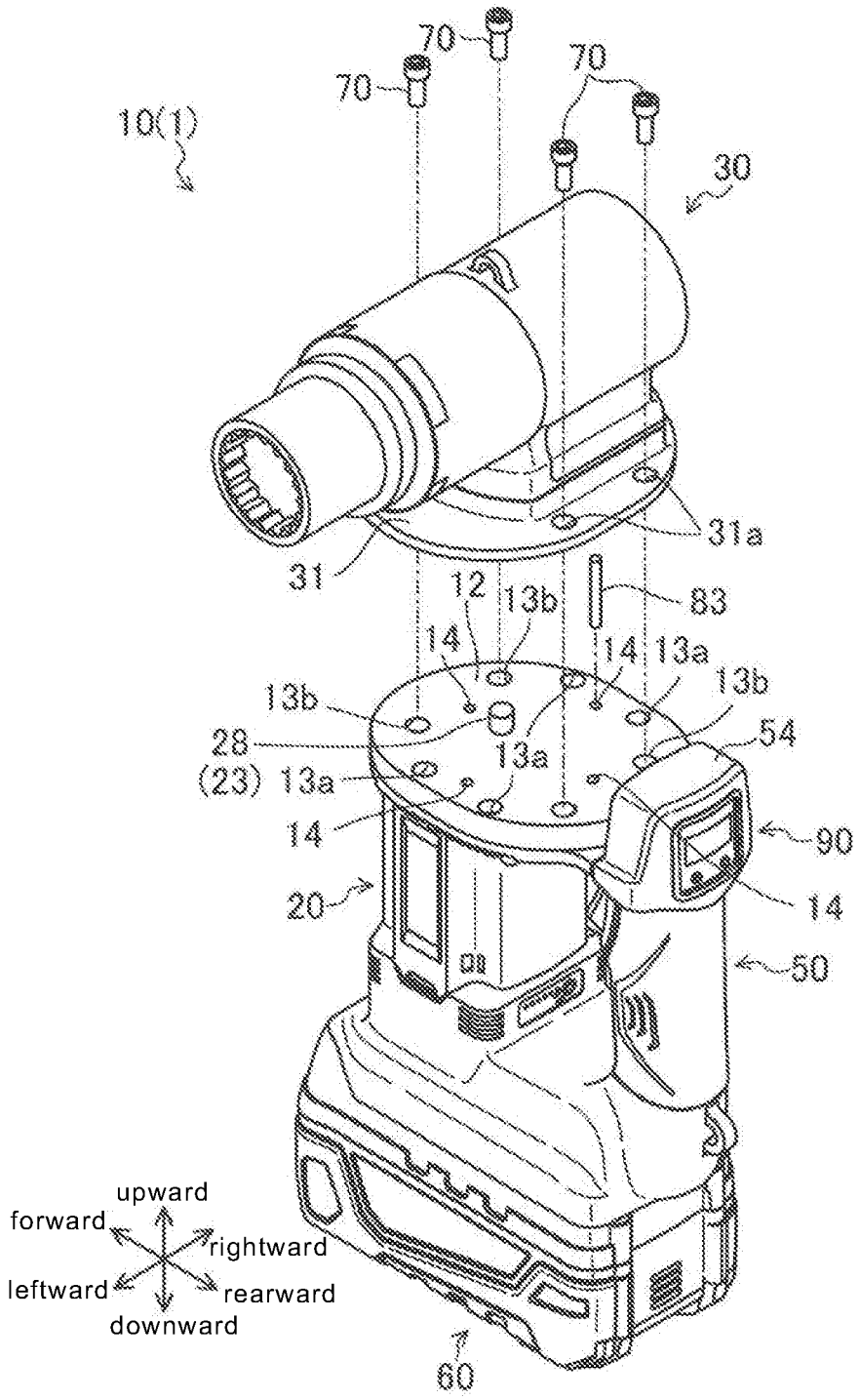
FIG. 6 and FIG. 7 are an exploded view and a rear view respectively of the electric tool in FIG. 1, showing the head section in the leftward-facing position.
Figure 7:
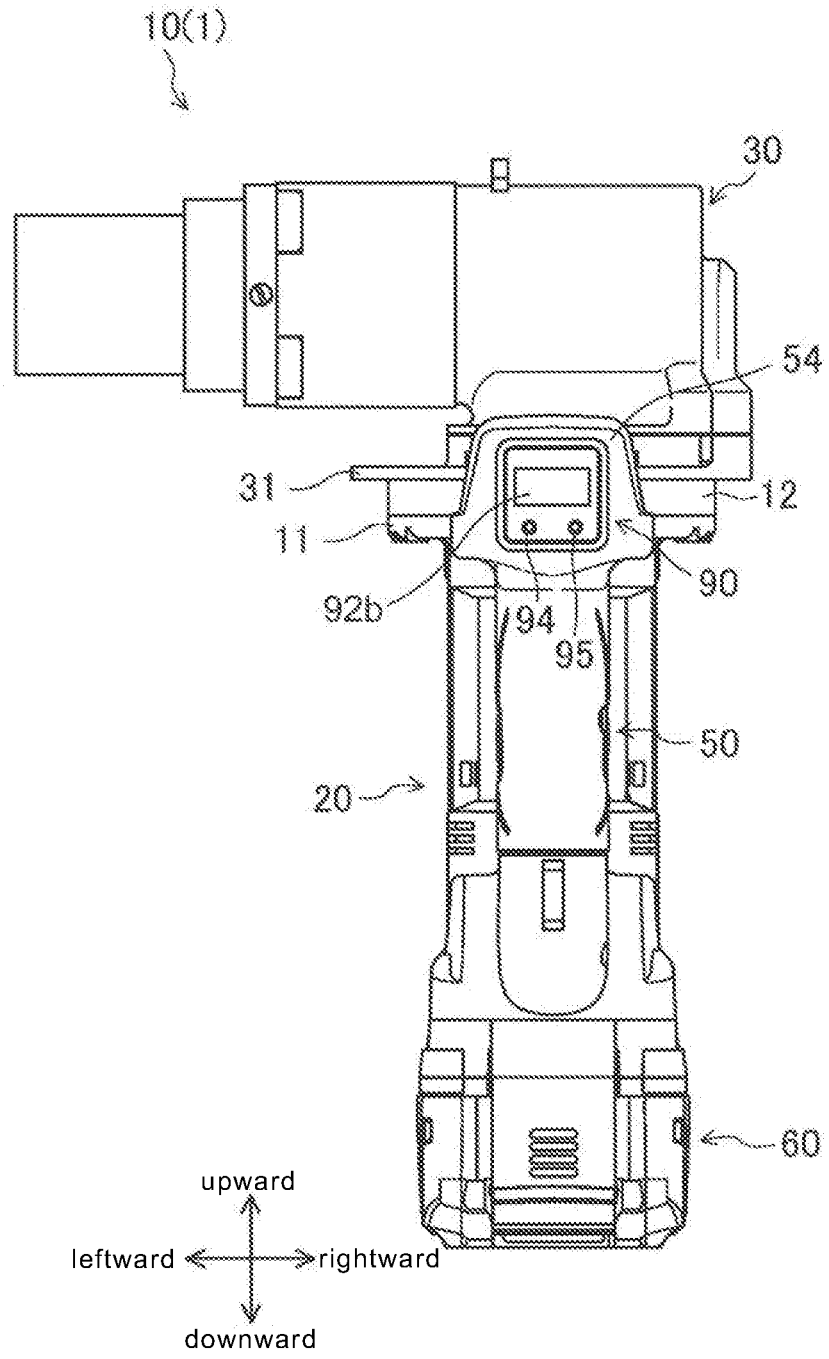

Referring to FIG. 6 and FIG. 9, the through holes 14 of the coupling section 12 correspond respectively in position to the sliding-element engaging portions 84*a* when the operating member 85 is not operated. Therefore, when the operating member 85 is not operated and the coupling rod 83 is inserted through the corresponding through hole 14 as shown in FIG. 9, the coupling-rod engaging portion 83*a* is engaged with the corresponding sliding-element engaging portion 84*a*.

The following paragraphs explain how the fragment ejecting mechanism 80 works.

In the first case, in which the head section 30 assumes the forward-facing position, the coupling rod 83 extends through the through hole 14 on the rear side.

Figure 11:
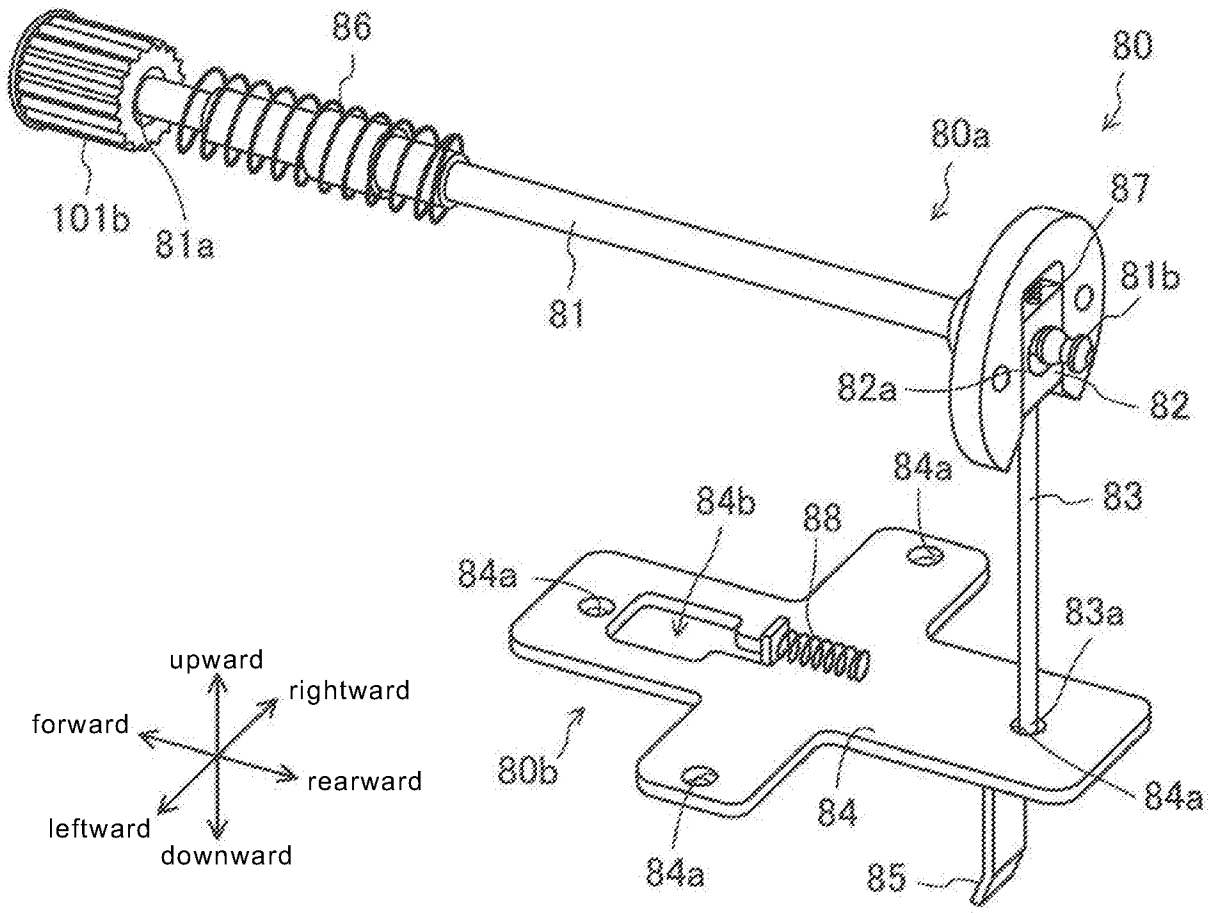
FIG. 11 and FIG. 12 schematically show how the fragment ejecting mechanism of the electric tool in FIG. 1 works while the head section of the electric tool is in the forward-facing position.

By inserting the fragment portion 101*b* of the shear bolt 101 into the inner socket 40, referring to FIG. 5, FIG. 9, and FIG. 11, the fragment rod 81 is moved rearward toward the receiving position against the elastic energy of the first spring 86, and the first spring 86 is compressed by the moving fragment rod 81. During the process, the stopper 82 is pushed upward by the to-be-stopped portion 81*b* against the elastic energy of the second spring 87, and once the planar portion 81*c* of the to-be-stopped portion 81*b* is reached, the stopper 82 is moved downward by the elastic energy of the second spring 87 and ends up engaged with the to-be-stopped portion 81*b*; thus, the restrained state takes place when the fragment rod 81 is at the receiving position. Now, with the fragment portion 101*b* in the inner socket 40, the fragment rod 81 is restrained from being displaced in the direction of the rotation axis of the inner socket 40, and the coupling rod 83 has been driven downward by the elastic energy transmitted from the second spring 87 through the stopper 82 such that the coupling-rod engaging portion 83*a* of the coupling rod 83 is engaged with the corresponding sliding-element engaging portion 84*a* of the sliding element 84.

Figure 12:
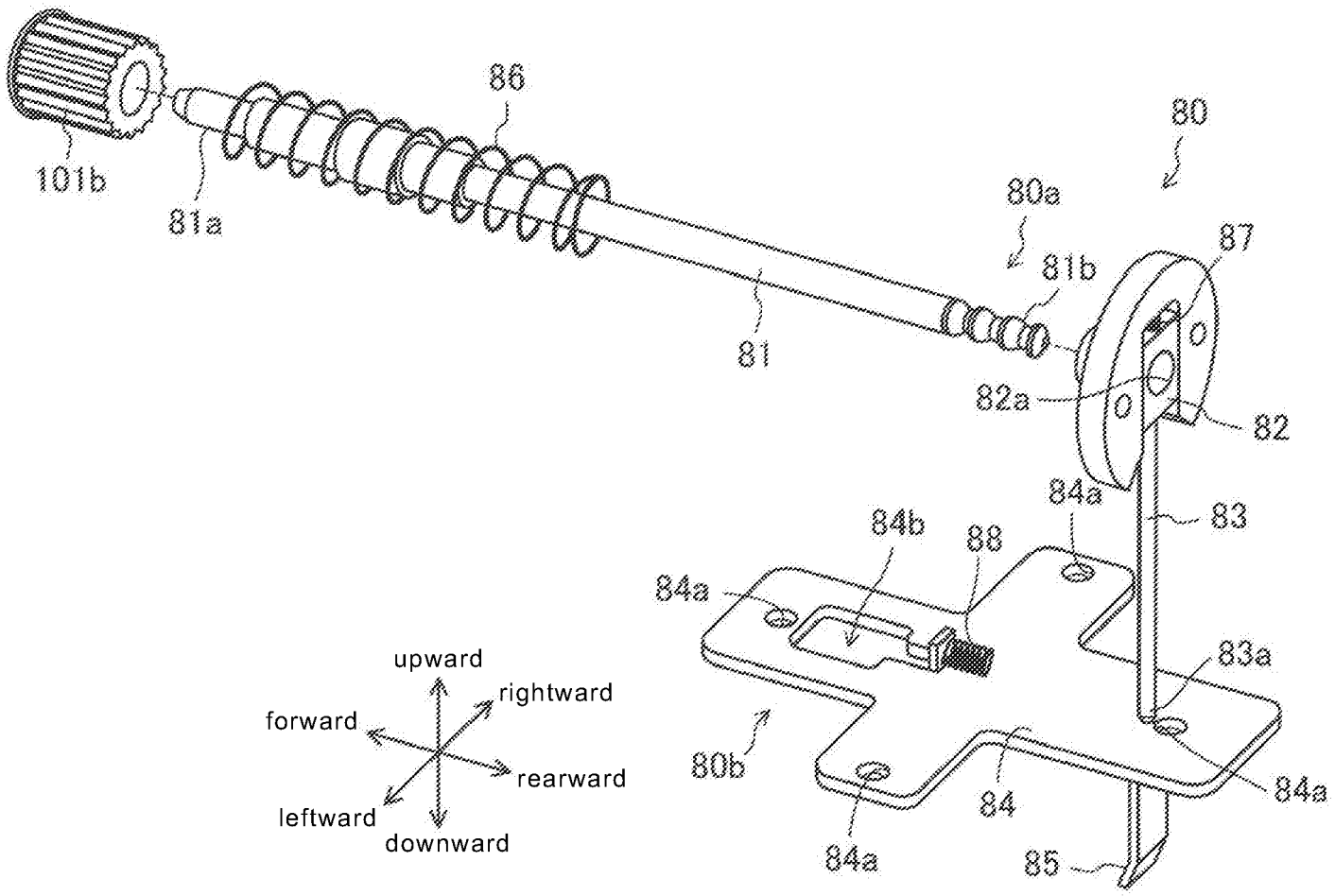

After completing the fastening operation on the nut 100 and the shear bolt 101, referring to FIG. 5, FIG. 9, and FIG. 12, the operating member 85 is pressed against the elastic energy of the third spring 88 and thus slides the sliding element 84 rearward. During the process, the coupling-rod engaging portion 83*a* of the coupling rod 83 is pushed upward by the periphery of the corresponding sliding-element engaging portion 84*a* such that the coupling rod 83 is moved upward against the elastic energy of the second spring 87. The coupling-rod engaging portion 83*a* is eventually disengaged from the corresponding sliding-element engaging portion 84*a* and moved onto the surface of the sliding element 84, thereby moving the stopper 82 upward against the elastic energy of the second spring 87. As a result, the to-be-stopped portion 81*b* is disengaged from the stopper 82 to bring about the released state, and the fragment rod 81 is consequently moved forward toward the ejecting position by the elastic energy of the first spring 86, with the contact portion 81*a* of the fragment rod 81 pressed against the fragment portion 101*b* and pushing the fragment portion 101*b* forward until the fragment portion 101*b* is ejected out of the inner socket 40.

Once the fragment portion 101*b* is pushed out of the inner socket 40, the user's finger is released from the operating member 85, allowing the elastic energy stored in the third spring 88 to slide the sliding element 84 and the operating member 85 forward. When the aforesaid sliding-element engaging portion 84*a* arrives at the position right under the coupling rod 83, the coupling rod 83 is moved downward by the elastic energy of the second spring 87 and thus brings the coupling-rod engaging portion 83*a* into engagement with the sliding-element engaging portion 84*a*.

In the second case, in which the head section 30 assumes the leftward-facing position as shown in FIG. 6, the coupling rod 83 extends through the through hole 14 on the right side.

Figure 13:
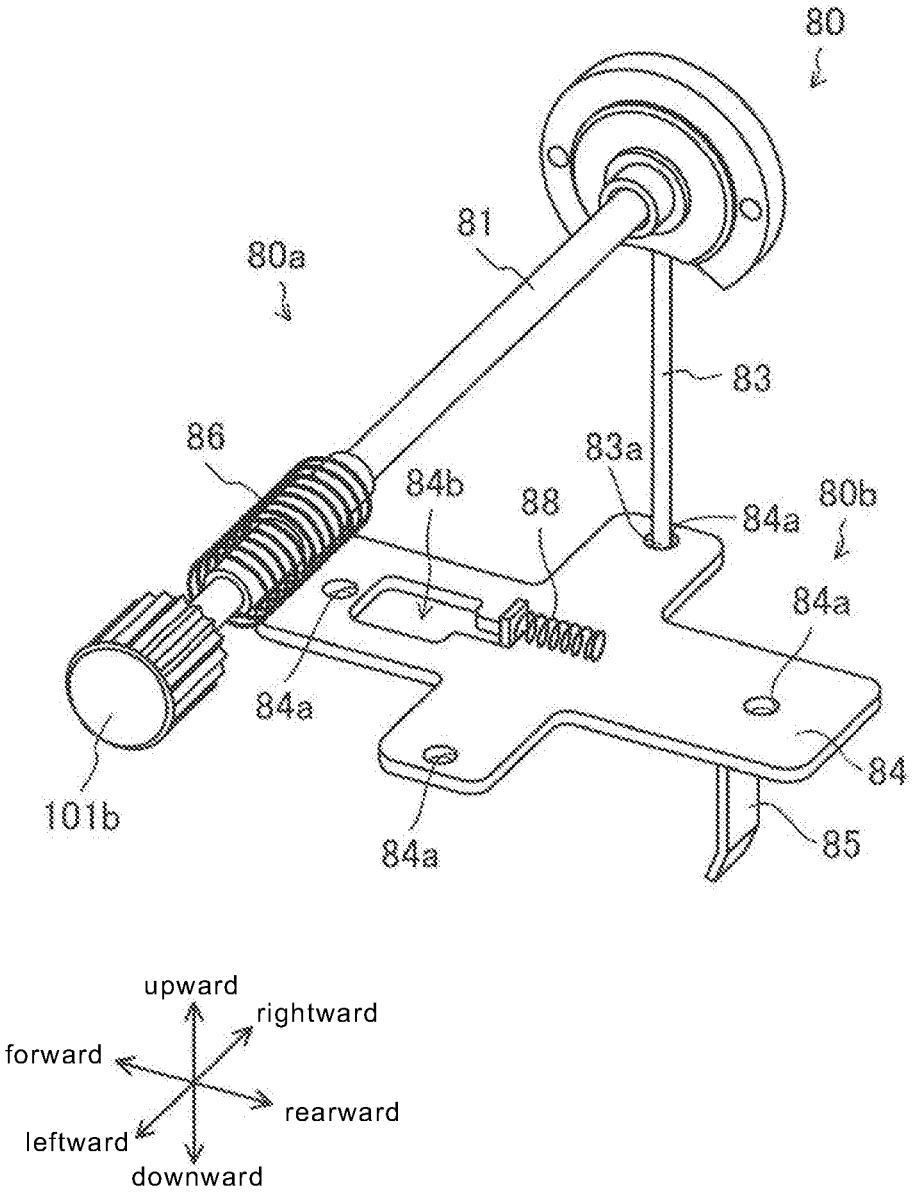
FIG. 13 and FIG. 14 schematically show how the fragment ejecting mechanism of the electric tool in FIG. 1 works while the head section of the electric tool is in the leftward-facing position.

By inserting the fragment portion 101*b* of the shear bolt 101 into the inner socket 40 while the head section 30 is in the leftward-facing position, referring to FIG. 5, FIG. 9, and FIG. 13, the fragment rod 81 is moved rightward toward the receiving position against the elastic energy of the first spring 86, and the first spring 86 is compressed by the moving fragment rod 81. During the process, the stopper 82 comes into engagement with the to-be-stopped portion 81*b* as in the previous case, and the restrained state takes place when the fragment rod 81 is at the receiving position. The coupling rod 83 in this state has been driven downward by the elastic energy transmitted from the second spring 87 through the stopper 82 such that the coupling-rod engaging portion 83*a* of the coupling rod 83 is engaged with the corresponding sliding-element engaging portion 84*a* of the sliding element 84.

Figure 14:
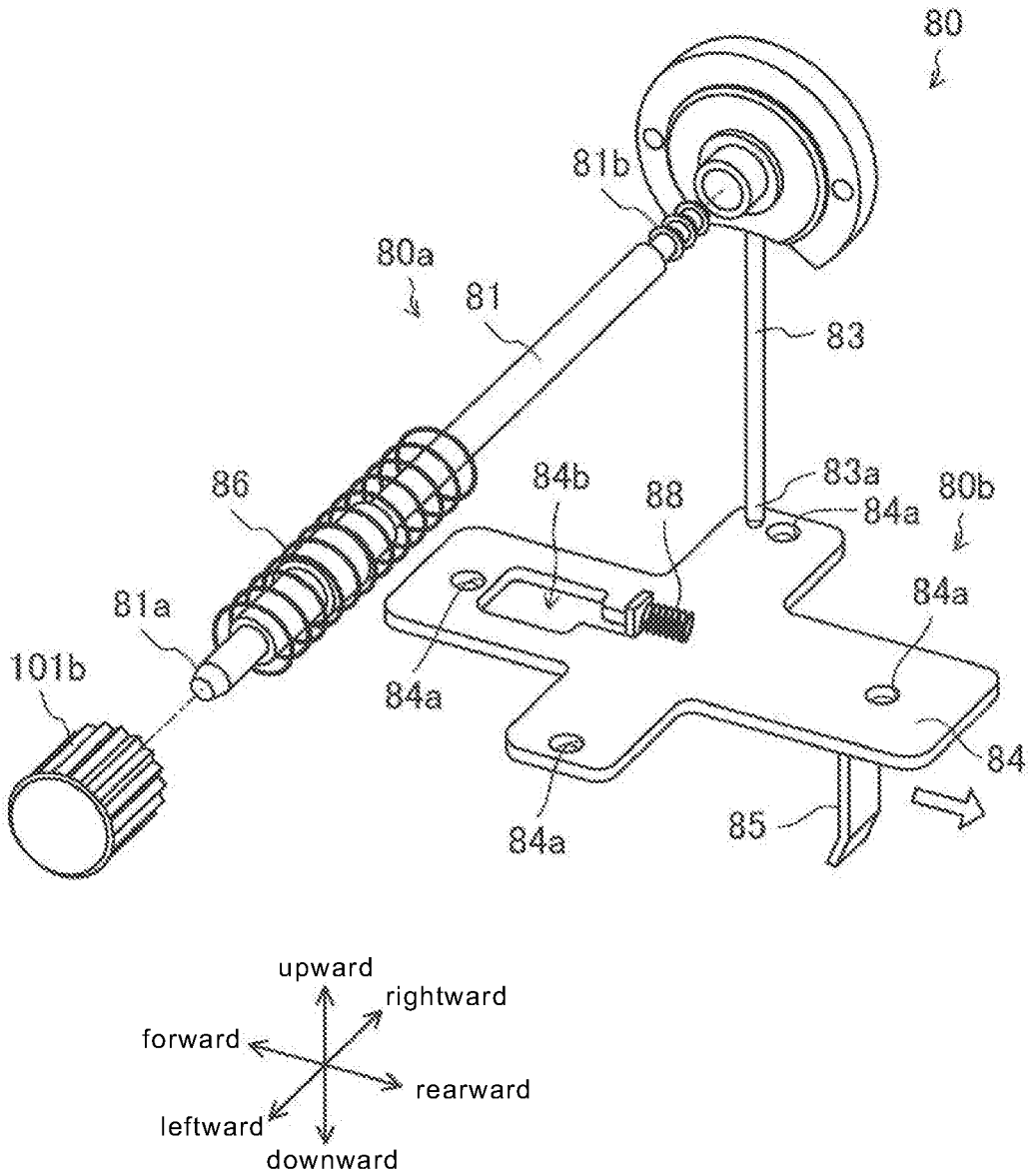

After completing the fastening operation on the nut 100 and the shear bolt 101, referring to FIG. 5, FIG. 9, and FIG. 14, the operating member 85 is pressed against the elastic energy of the third spring 88 and thus slides the sliding element 84 rearward. During the process, the coupling rod 83 is moved upward against the elastic energy of the second spring 87 as in the previous case, where the head section 30 is in the forward-facing position, and the coupling-rod engaging portion 83*a* is eventually disengaged from the corresponding sliding-element engaging portion 84*a*, with the coupling rod 83 moved onto the surface of the sliding element 84 and thus moving the stopper 82 upward against the elastic energy of the second spring 87. As a result, the to-be-stopped portion 81*b* is disengaged from the stopper 82 to bring about the released state, and the fragment rod 81 is consequently moved leftward toward the ejecting position by the elastic energy of the first spring 86, with the contact portion 81*a* of the fragment rod 81 pressed against the fragment portion 101*b* and pushing the fragment portion 101*b* leftward until the fragment portion 101*b* is ejected out of the inner socket 40.

Once the user's finger is released from the operating member 85, the sliding element 84 and the operating member 85 are slid forward by the elastic energy of the third spring 88. When the aforesaid sliding-element engaging portion 84*a* arrives at the position right under the coupling rod 83, the coupling rod 83 is moved downward by the elastic energy of the second spring 87 and thus brings the coupling-rod engaging portion 83*a* into engagement with the sliding-element engaging portion 84*a*.

It can be known from the above that each sliding-element engaging portion 84*a* can be used to move the coupling rod 83 upward against the elastic energy of the second spring 87 by sliding the sliding element 84 rearward. That is to say, each sliding-element engaging portion 84*a* constitutes a moving mechanism.

When the head section 30 assumes the rearward-facing or rightward-facing position, the fragment ejecting mechanism 80 works in the same way as described above except that the coupling rod 83 extends through a different through hole 14, that the coupling-rod engaging portion 83*a* is engaged with and disengaged from a different sliding-element engaging portion 84*a*, and that the fragment rod 81 is moved in a different direction.

According to the above, and referring to FIG. 5, FIG. 6, and FIG. 9, the electric tool 1 according to this embodiment is so designed that even after the pointing direction of the front end of the head section 30 is changed with respect to the motor section 20 and the handle section 50 along the radial direction of the motor shaft 23, the coupling rod 83 will be able to extend through the corresponding through hole 14 and engage with the corresponding sliding-element engaging portion 84*a* to link the pushing portion 80*a* and the driving portion 80*b* of the fragment ejecting mechanism 80 mechanically together, allowing the fragment portion 101*b* left in the inner socket 40 to be ejected regardless of the orientation of the head section 30.

In this embodiment, the pushing portion 80*a* and the driving portion 80*b* of the fragment ejecting mechanism 80 are mechanically linked by the coupling rod 83 extending in a up and down direction, and the plurality of through holes 14, which are provided in the coupling section 12 and configured for selective penetration by the coupling rod 83, are so located that there will always be one through hole 14 corresponding to the coupling rod 83 after the pointing direction of the front end of the head section 30 is changed. Therefore, not only is the pushing portion 80*a* activated in a purely mechanical manner, i.e., without using battery power, but also the coupling rod 80 can be passed through the corresponding through hole 14 to couple and link the pushing portion 80*a* and the driving portion 80*b* mechanically each time the pointing direction of the front end of the head section 30 is changed. The foregoing design makes it possible for the electric tool 1 to eject the fragment portion 101*b* with ease and use less of the electricity stored in the battery 60 than those conventional electric tools that allow the pointing direction of the front end of the head section 30 to be changed with respect to the motor section 20 and the handle section 50.

Moreover, the fragment rod 81 in this embodiment extends through the fourth intermediate gear 36 and the guiding element 89 and therefore will be guided by the fourth intermediate gear 36 and the guiding element 89 and kept from going astray while being moved between the receiving position and the ejecting position along the direction of the rotation axis of the inner socket 40. This enables easier and more effective ejection of the fragment portion 101*b* than if the fragment rod 81 is otherwise arranged.

In addition, as the stopper 82 in this embodiment is configured to be disengaged from the fragment rod 81 simply by an upward movement of the coupling rod 83, the coupling rod 83 does not require a large space in which to move, and this contributes to miniaturization of the fragment ejecting mechanism 80.

Furthermore, the coupling rod 83 in this embodiment extends in a up and down direction through the second intermediate gear 34, so the second intermediate gear 34 produces a guiding effect on the coupling rod 83 when the coupling rod 83 is vertically moved, ensuring that force is transmitted smoothly between the coupling rod 83 and the stopper 82 and that therefore the fragment portion 101*b* is ejected more easily and more effectively than if the coupling rod 83 is otherwise arranged.

This embodiment utilizes the movement of the coupling rod 83 onto the surface of the sliding element 84, so the sliding element 84 need not be provided with projections or given a large space in which to move. This also contributes to miniaturization of the fragment ejecting mechanism 80.

Besides, the sliding-element engaging portions 84*a* and the coupling-rod engaging portion 83*a* of the coupling rod 83 in this embodiment have matching tapered configurations that allow the coupling rod 83 to be moved smoothly upward by the sliding movement of the sliding element 84 to facilitate ejection of the fragment portion 101*b*.

Figure 15:
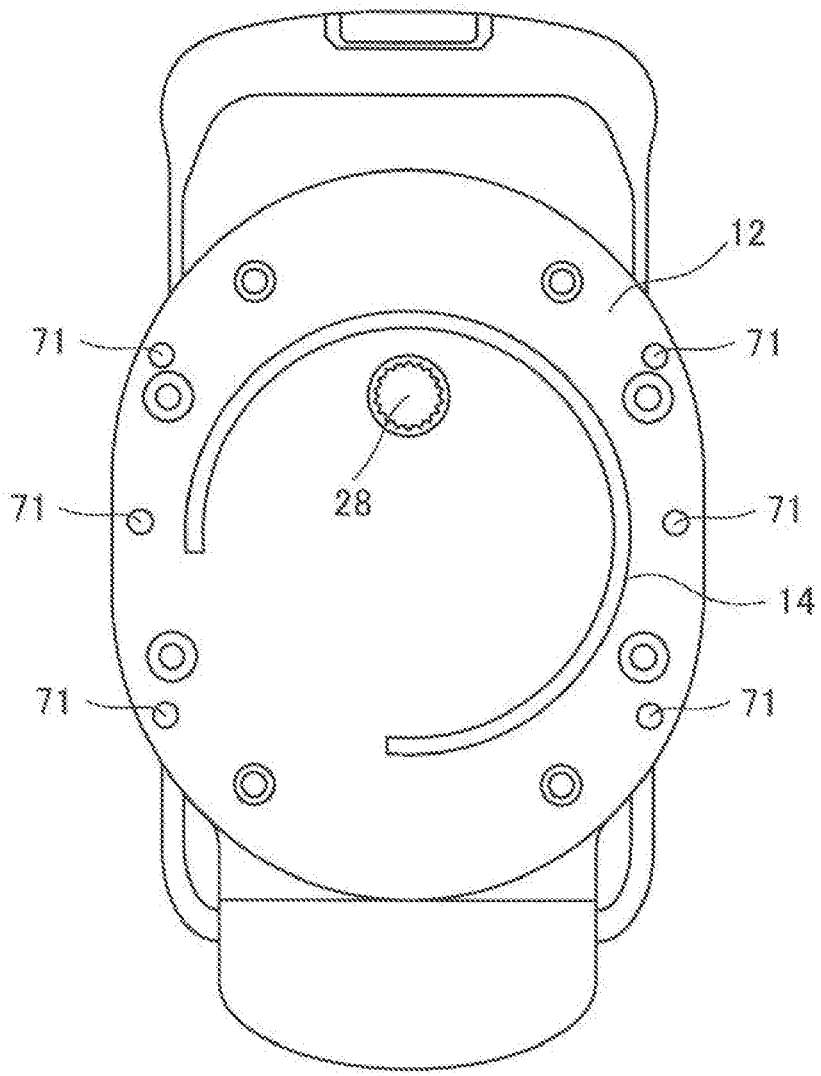
FIG. 15 shows another embodiment of the through holes of the electric tool in FIG. 1.

Referring to FIG. 15 in conjunction with FIG. 9 for a variant of the foregoing embodiment, the coupling section 12 in this variant has a C-shaped through hole 14 so that the coupling rod 83 can stay in the through hole 14 and keep the pushing portion 80*a* and the driving portion 80*b* mechanically linked while the pointing direction of the front end of the head section 30 is being changed.

Figure 16:
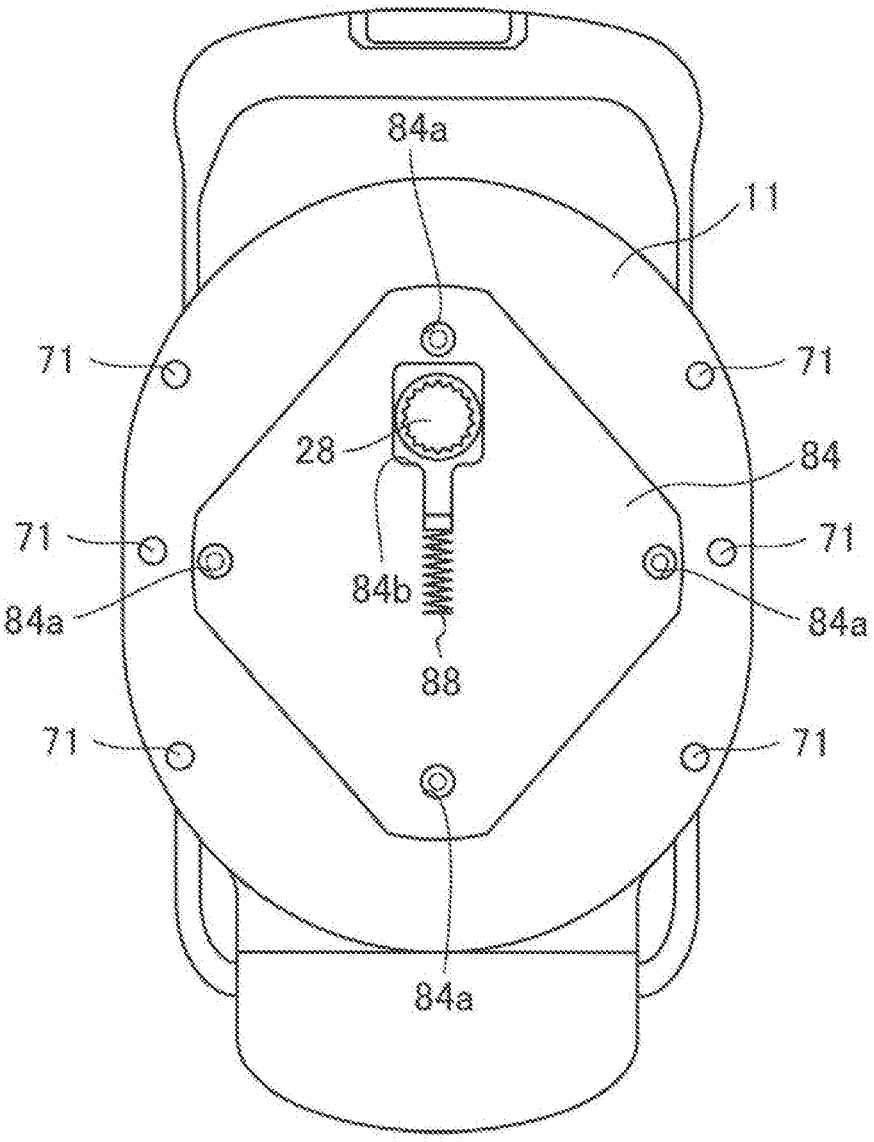
FIG. 16 shows another embodiment of the sliding element of the electric tool in FIG. 1.

Referring to FIG. 16 in conjunction with FIG. 5 and FIG. 9 for another variant of the foregoing embodiment, the sliding element 84 in this variant has an octagonal shape, with the sliding-element engaging portions 84*a* occupying the same positions as in the embodiment described above. When this sliding element 84 is moved rearward by operating (i.e., pulling) the operating member 85, the coupling rod 83 will also be moved upward onto the surface of the sliding element 84, thereby triggering the pushing portion 80*a* to eject the fragment portion 101*b* left in the inner socket 40.

It should be pointed out that the present invention is not limited to the embodiment or variants described above. The elements disclosed herein may be substituted with their respective equivalents without departing from the scope of the appended claims.

For instance, while the sliding-element engaging portions 84*a* and the coupling-rod engaging portion 83*a* of the coupling rod 83 in the foregoing embodiment have matching tapered peripheries respectively, it is not necessary that the same tapered configurations are used in other embodiments. The sliding-element engaging portions 84*a* and the coupling-rod engaging portion 83*a* of the coupling rod 83 may have any other shapes, provided that the coupling rod 83 can be moved upward by the sliding movement of the sliding element 84. For example, each sliding-element engaging portion 84*a* may have a front portion formed as a rearwardly and downwardly inclined surface and a rear portion formed as a plane that extends in a up and down direction and in the left-right direction while the coupling-rod engaging portion 83*a* of the coupling rod 83 corresponds in shape to the inclined surface. As another example, each sliding-element engaging portion 84*a* may have a concave spherical surface while the coupling-rod engaging portion 83*a* of the coupling rod 83 is hemispherical.

In fact, the sliding-element engaging portions 84*a* are not necessarily holes and may be grooves instead, for example. When the sliding-element engaging portions 84*a* are grooves, such grooves may form a single groove structure that extends along the entire periphery of the sliding element 84; in that case, it can be said that there is only one moving mechanism for moving the coupling rod 83 upward.

Figure 8:
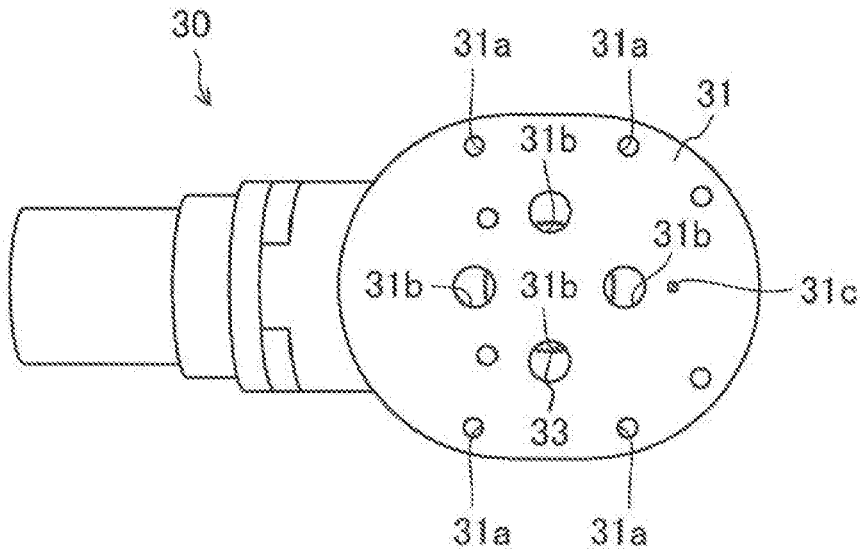
FIG. 8 is a bottom view of the head section connecting base of the electric tool in FIG. 1.

Moreover, referring to FIG. 6 and FIG. 8, while the head section 30 in the foregoing embodiment is configured to assume one of the forward-facing, rearward-facing, leftward-facing, and rightward-facing positions, it is not necessary that the head section 30 can be rotated only to those positions. For example, the head section 30 may be configured to also assume a position between the forward-facing position and the leftward-facing position, and to achieve this end, it is required to increase the number of the threaded holes 13*a* and 13*b* of the coupling section 12, the number of the through holes 14, and the number of the motor through holes 31*b*, or to use the C-shaped hole in the variant shown in FIG. 15, in order for the head section 30 (see FIG. 6) to have more alternative angular positions, or orientations.

Furthermore, referring to FIG. 3, FIG. 10, and FIG. 16, while the sliding element 84 in the foregoing embodiment is cross-shaped as shown in FIG. 10 or octagonal as shown in FIG. 16, the shape of the sliding element 84 is not limited to the two demonstrated herein. The sliding element 84 may have any other shapes, provided that the sliding element 84 does not interference with the threaded elements used to connect the head section carrying portion 11, the coupling section 12, and the head section connecting base 31 and can be moved in the front-rear direction.

Figure 17:
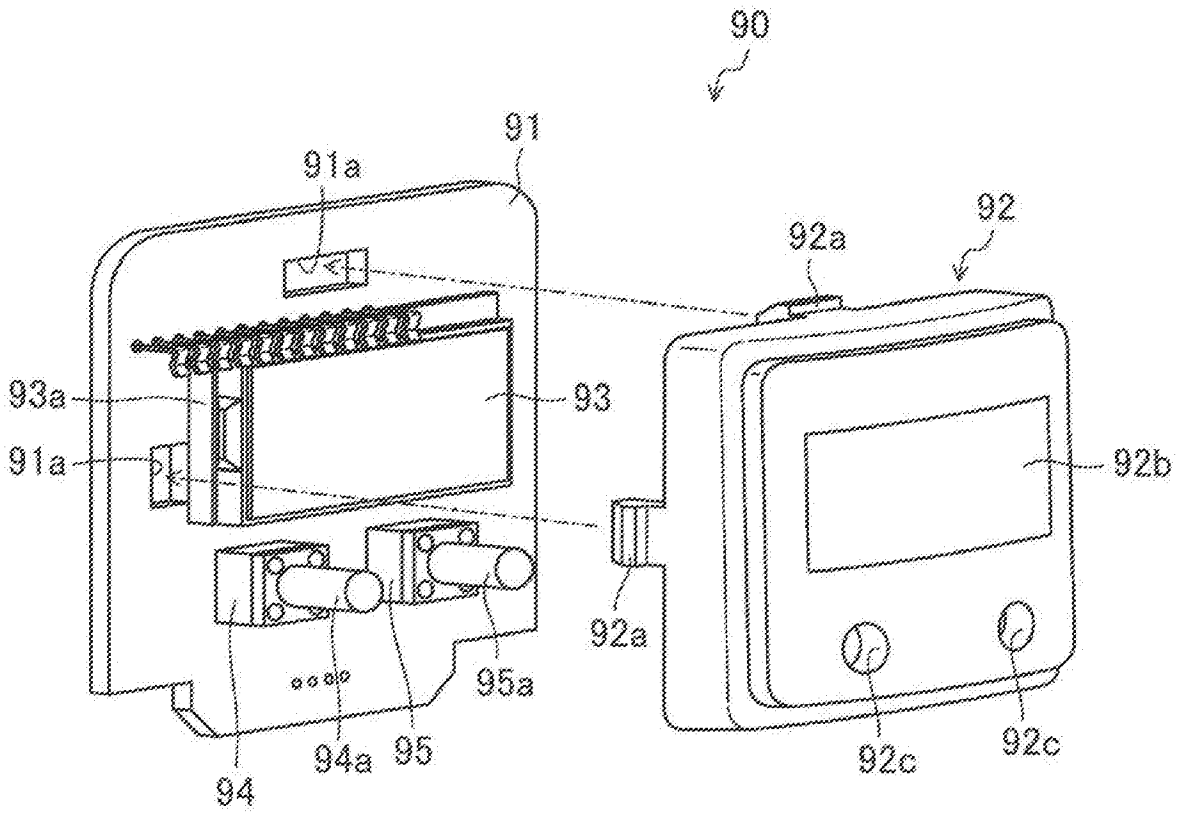
FIG. 17 is an exploded perspective view of the display device of the electric tool in FIG. 1.
Figure 18:
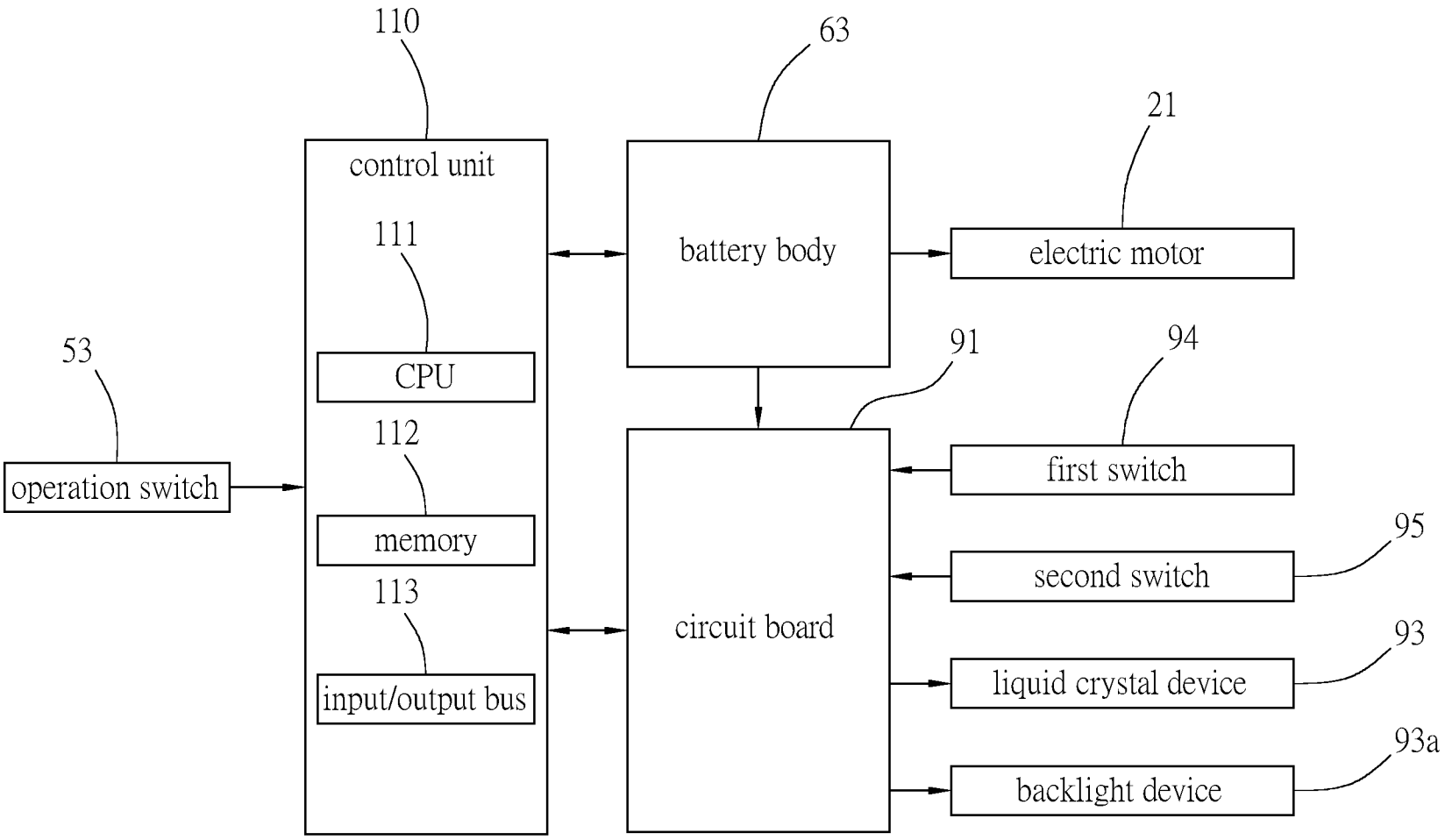
FIG. 18 is a block diagram of the electric tool in FIG. 1.

Referring to FIG. 1, FIG. 17 and FIG. 18, the display device 90 is disposed on a surface portion of the rear side of the tool body 10 and has a circuit board 91 and a cover portion 92. The circuit board 91 is provided with a plurality of holes 91*a*. The cover portion 92 is mounted on the circuit board 91 and is provided with a plurality of claws 92*a* corresponding respectively in position to the holes 91*a*. The cover portion 92 is mounted on the circuit board 91 through the engagement between each claw 92*a* and the corresponding hole 91*a*.

The circuit board 91 is provided with a liquid crystal device 93 for displaying fastening information. A first switch 94 and a second switch 95 are provided below the liquid crystal device 93 and are arranged side by side in the left-right direction. The first switch 94 can be used to change the fastening information displayed by the liquid crystal device 93, and the second switch 95, to operate a backlight device 93*a* on the rear side of the liquid crystal device 93. The first switch 94 and the second switch 95 are configured to be activated by the user pressing a first pressing portion 94*a* and a second pressing portion 95*a* respectively, wherein the first and the second pressing portions 94*a* and 95*a* are provided at the front ends of the first and the second switches 94 and 95 respectively. In this embodiment, the first switch 94 serves as a reset button, and in order to prevent an inadvertent press on the first pressing portion 94*a* from triggering the reset operation, the first switch 94 can be designed to start the reset operation only after it is pressed for at least two seconds.

The cover portion 92 has a transparent part 92*b* corresponding in position to the liquid crystal device 93 so that the user can see through the transparent part 92*b* and check the fastening information displayed by the liquid crystal device 93; in other words, the transparent part 92*b* can be viewed as a displayed image. The cover portion 92 is provided with two through holes 92*c*, through which the first pressing portion 94*a* and the second pressing portion 94*b* are respectively inserted.

The display device 90 is fitted in the upwardly extending mounting portion 54, with the cover portion 92 exposed to view. Thus, the display device 90 is located at a higher position than the handle section 50.

The control unit 110 is a controller based on a conventional microcomputer. The control unit 110 has a central processing unit (CPU) 111, a memory 112, and an input/output bus 113, among other components. The CPU 111 is a central algorithm processing device configured to execute computer programs (including a basic control program, such as an operating system (OS), and application programs to be started through the OS to perform specific functions). The memory 112 is composed of a read-only memory (ROM) and a random-access memory (RAM). The ROM stores the aforesaid computer programs and the mapping data required for executing the computer programs. The RAM includes memories for use by the CPU 111 while the CPU 111 performs a series of operations. The input/output bus 113 is configured for inputting electronic signals into and outputting electronic signals from the control unit 110.

Referring to FIG. 5, FIG. 17, and FIG. 18, the control unit 110 is connected to the operation switch 53, the battery body 63, and the circuit board 91, among other components. The control unit 110 uses the magnitude of the current flowing through the electric motor 21 to calculate the load applied to the electric motor 21. More specifically, the larger the current through the electric motor 21, the greater the load determined by the control unit 110. The control unit 110 determines whether the fastening operation on the nut 100 and the shear bolt 101 has come to an end (i.e., whether the fragment portion 101*b* of the shear bolt 101 has been twisted off the fastening portion 101*a*) according to changes in the load applied to the electric motor 21 (or changes in the current value to be exact).

Figure 19:
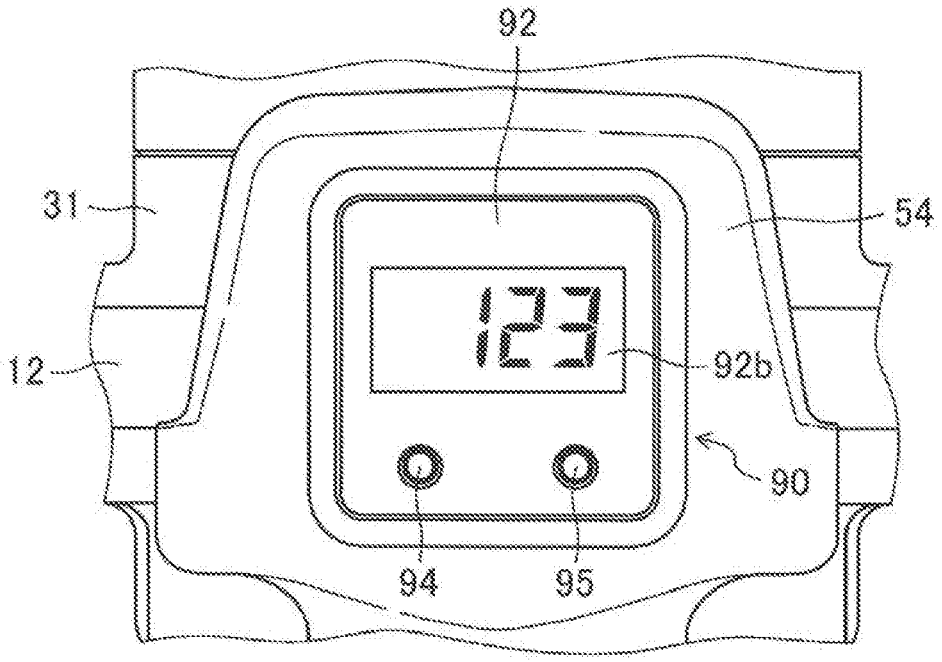
FIG. 19 schematically shows the information displayed by the display device of the electric tool in FIG. 1.
Figure 20:
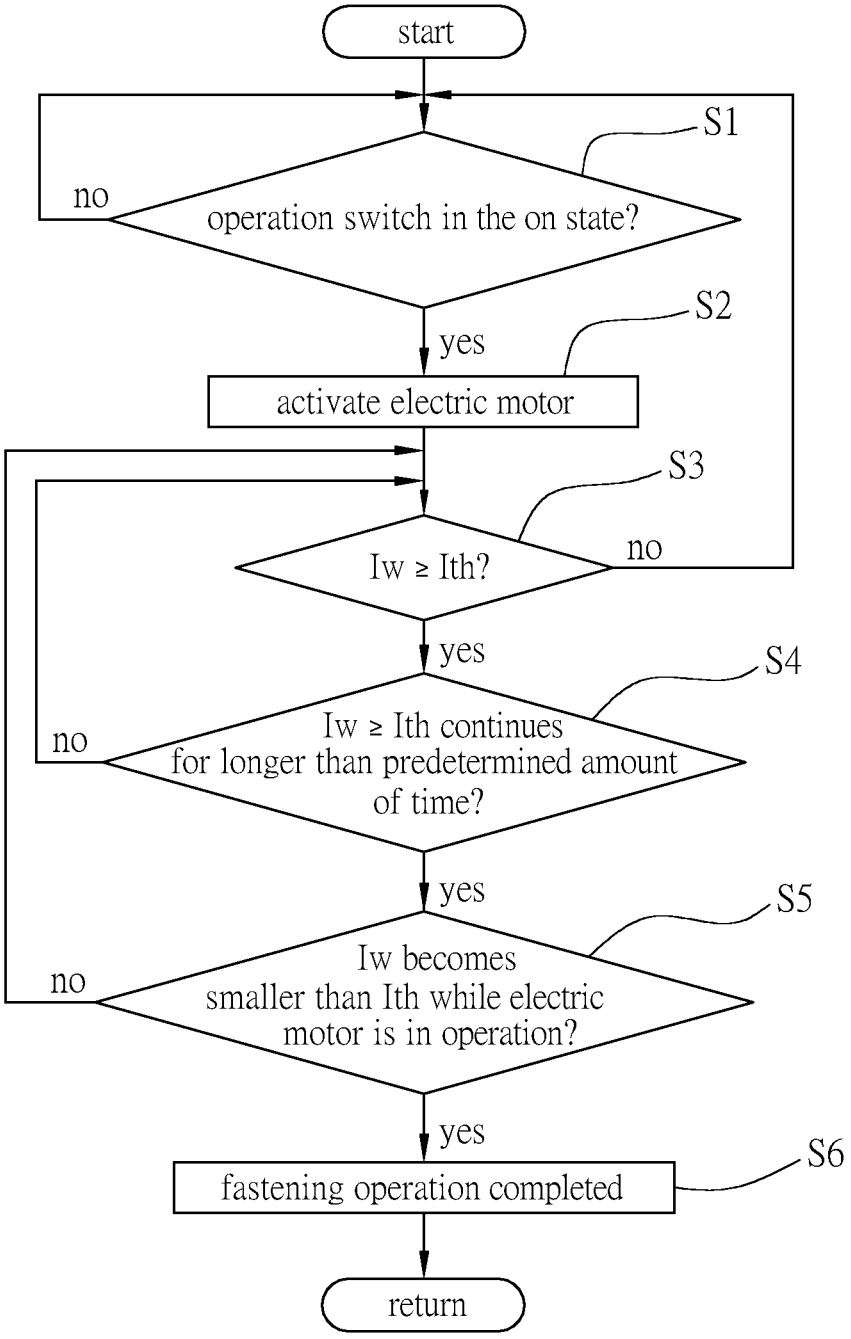
FIG. 20 is a flowchart showing the steps to be performed by the control unit of the electric tool in FIG. 1 during a fastening operation.

In this embodiment, the fastening information displayed by the display device 90 is the number of shear bolts 101 that have been fastened with the electric tool 1 (i.e., the number of the fastening operations completed, hereinafter referred to as the count). Once the control unit 110 determines that a fastening operation is completed, the current count in the memory 112 is added by 1 by the control unit 110, and the circuit board 91 receives a count-related signal from the control unit 110 and displays the count on the display device 90 (see FIG. 19). The method by which the control unit 110 determines the number of the fastening operations completed will be detailed further below.

When the user presses the first pressing portion 94*a*, the circuit board 91 sends a reset signal to the control unit 110. The control unit 110 responds to the reset signal by adjusting the count in the memory 112 to zero, so the count displayed by the liquid crystal device 93 becomes zero.

When the user presses the second pressing portion 95*a*, the circuit board 91 sends to the control unit 110 a signal for activating the backlight device 93*a*. The control unit 110 responds to the activating signal by allowing the electricity required for activating the backlight device 93*a* to be supplied from the battery body 63 to the circuit board 91 in order to activate the backlight device 93*a*.

Referring to FIG. 1, FIG. 4, and FIG. 5, the display device 90 used for displaying fastening operation-related information is disposed at a position higher than the grip area 51, which is the portion actually grasped by the user, so that the image displayed by the display device 90 will not be blocked by the user's wrist when the user is grasping the grip area 51. During a fastening operation, therefore, the user can check fastening operation-related information directly from where they stand to perform the fastening operation, without having to tilt the electric tool 1 or move their body.

Even when the user holds the handle section 50 with both hands to secure the electric tool 1 against a relatively large torque used to twist off the fragment portion 101*b*, the user can still directly see the image displayed by the display device 90 and check fastening operation-related information with ease.

The display device 90 is disposed in the upwardly extending mounting portion 54 and on a surface portion of the rear side of the tool body 10 to not only make efficient and flexible use of the area between the rear end of the handle section 50 and the rear end of the head section 30, but also make it easier for the user to check fastening operation-related information.

In this embodiment, the fastening operation-related information displayed by the display device 90 is the count of shear bolts 101 that have been fastened with the electric tool 1. The count is readily discernable and helps increase the efficiency of fastening operations performed with the electric tool 1.

It is worth mentioning that while the information displayed by the display device 90 in this embodiment is the count of shear bolts 101 that have been fastened with the electric tool 1, the information displayed by the display device 90 may also include such information as the load applied to the electric motor 21 while the nut 100 and the shear bolt 101 are being fastened; in that case, the information displayed by the display device 90 provides a basis on which the user can adjust the force or torque they exert to support the electric tool 1.

In this embodiment, referring to FIG. 1 and FIG. 17, the axial length of the first pressing portion 94*a* may be smaller than the length of the through holes 92*c* in the insertion direction so that, once the cover portion 92 is mounted on the circuit board 91, the front end of the first pressing portion 94*a* is halfway in the corresponding through hole 92*c*, lest the user press the first pressing portion 94*a* by accident during a fastening operation. It is understood, however, that the axial length of the first pressing portion 94*a* need not be so designed and may be greater than or equal to the length of the through holes 92*c* in the insertion direction to meet practical needs.

In this embodiment, the axial length of the second pressing portion 95*a* may be greater than the length of the through holes 92*c* in the insertion direction so that, once the cover portion 92 is mounted on the circuit board 91, the front end of the second pressing portion 95*a* protrudes rearward from the corresponding through hole 92*c*, making it easier for the user to press the second switch 95 while grasping the grip area 51. It is understood, however, that the axial length of the second pressing portion 95*a* need not be so designed and may be smaller than or equal to the length of the through holes 92*c* in the insertion direction to meet practical needs.

If the display device 90 in this embodiment is configured to display multiple pieces of information, the display device 90 may be further provided with a switch (not shown) for switching between the different pieces of information to be displayed.

The first switch 94 in this embodiment may be dispensed with; in that case, the display device 90 will display the total number of shear bolts 101 (see FIG. 5) that have been fastened with the electric tool 1 so far. This configuration allows the user or the manufacturer of the electric tool 1 to know the maximum number of shear bolts 101 that the electric tool 1 can twist off before malfunctioning.

In this embodiment, the display device 90 is fitted in the upwardly extending mounting portion 54, and the upwardly extending mounting portion 54 extends upward from an upper end of the handle section 50 and is integrally formed with the handle section 50. This configuration, however, is provided herein by way of example only. The display device 90 and the handle section 50 may be mounted on the rear side of the head section 30 as separate components.

Referring to FIG. 5, FIG. 17, FIG. 18, and FIG. 20, the control unit 110 determines whether the fastening operation on the nut 100 and the shear bolt 101 is completed, wherein the determination is based on changes in magnitude of the current flowing from the battery body 63 to the electric motor 21. In other words, the control unit 110 constitutes a determination section.

The control unit 110 also counts the fastening operations completed and therefore constitutes a counting section. The counting operation of the control unit 110 may be permanent computation, with the resulting count indicating the accumulated number of fastening operations, and when the control unit 110 receives the reset signal, the count will be zeroed and start all over again.

In this embodiment, there are three criteria by which the control unit 110 determines whether a fastening operation is completed. The three determination criteria include a criterion for commencement, a criterion for continuation, and a criterion for completion. The criterion for commencement is that the working current Iw supplied from the battery body 63 to the electric motor 21 should be larger than a predetermined current threshold value Ith. More specifically, once the nut 100 is fastened to the fastening portion 101*a* to a certain degree, the step of twisting the fragment portion 101*b* off the fastening portion 101*a* begins with an increase in the load applied to the electric motor 21, and to generate a torque (rotating force) large enough to overcome the increased load, the working current Iw supplied to the electric motor 21 will be increased. So, based on the criterion for commencement, the control unit 110 can determine whether the step of twisting the fragment portion 101*b* off the fastening portion 101*a* has commenced. The predetermined current threshold value Ith is larger than the inrush current required to activate the electric motor 21 and smaller than the current supplied from the battery 60 to the electric motor 21 when the fragment portion 101*b* is twisted off the fastening portion 101*a*.

The criterion for continuation is that the working current Iw should stay larger than the predetermined current threshold value Ith at least for a predetermined amount of time. More specifically, to twist the fragment portion 101*b* off the fastening portion 101*a*, the rotating force of the electric motor 21 must be applied to the shear bolt 101 continuously over a certain period of time. Therefore, by taking into account the criterion for continuation, the control unit 110 is prevented from mistaking an uncompleted fastening operation as completed should the criterion for completion be accidentally satisfied by a low power level of the battery 60 or by an inadvertent disengagement of the fragment portion 101*b* from the inner socket 40 (see FIG. 4).

The criterion for completion is that the working current Iw should change from a value greater than the predetermined current threshold value Ith to a value smaller than the predetermined current threshold value Ith while the electric motor 21 is in operation. More specifically, as soon as the fragment portion 101*b* is twisted off the fastening portion 101*a*, the electric tool 1 enters an idle state, in which the working current Iw supplied to the electric motor 21 is reduced in response to a reduction in the load applied to the electric motor 21. Thus, based on the criterion for completion, the control unit 110 can determine whether the fragment portion 101*b* has been twisted off the fastening portion 101*a*.

The determination criteria should be satisfied in the following order: the criterion for commencement is satisfied first, followed sequentially by the criterion for continuation and the criterion for completion. By checking the variation of the current supplied to the electric motor 21 against the three criteria (i.e., the criterion for commencement, the criterion for continuation, and the criterion for completion) and verifying that the three criteria are satisfied in the specified order, the control unit 110 can accurately determine that the fastening operation on the nut 100 and the shear bolt 101 is completed.

After determining that the determination criteria are satisfied and that the fastening operation in question is therefore completed, the control unit 110 adds 1 to the count currently stored in the memory 112 and sends a count-related signal to the circuit board 91 in order for the display device 90 to display a new number, which is greater than the currently displayed number by 1.

Moreover, upon determining that the fastening operation is completed, the control unit 110 sends a signal to the circuit board 91 to activate the backlight device 93*a*. The circuit board 91 activates the backlight device 93*a* in response to the signal received, and the circuit board 91 activates the backlight device 93*a* only for a preset amount of time (e.g., 2 seconds or so).

Referring to FIG. 5, FIG. 18, FIG. 20, and FIG. 21, the following paragraphs detail the steps to be performed by the control unit 110 during the fastening operation on the nut 100 and the shear bolt 101.

To begin with, the control unit 110 determines in step S1 whether the operation switch 53 is in the on state. If an activating signal has been sent out from the operation switch 53, the control unit 110 will determine that the operation switch 53 is in the on state, and then the process flow goes on to step S2. If no activating signal has been sent out from the operation switch 53, the control unit 110 will determine that the operation switch 53 is in the off state, and step S1 will be repeated.

In step S2, the control unit 110 activates the electric motor 21.

In step S3, the control unit 110 determines whether the criterion for commencement is satisfied, i.e., whether the working current Iw is larger than the predetermined current threshold value Ith. If yes, step S4 will be performed; otherwise, the process flow goes back to step S1.

In step S4, the control unit 110 determines whether the criterion for continuation is satisfied, i.e., whether the working current Iw is larger than the predetermined current threshold value Ith and remains so at least for the predetermined amount of time. If yes, step S5 will be performed; otherwise, the process flow goes back to step S3.

In step S5, the control unit 110 determines whether the criterion for completion is satisfied, i.e., whether the working current Iw is changed from a value greater than the predetermined current threshold value Ith to a value smaller than the predetermined current threshold value Ith while the electric motor 21 is operating. If yes, step S6 will be performed; otherwise, the process flow goes back to step S3.

In step S6, the control unit 110 determines that the fastening operation is completed and then adds 1 to the current count in the memory 112, before the process flow returns to the start.

Figure 21:
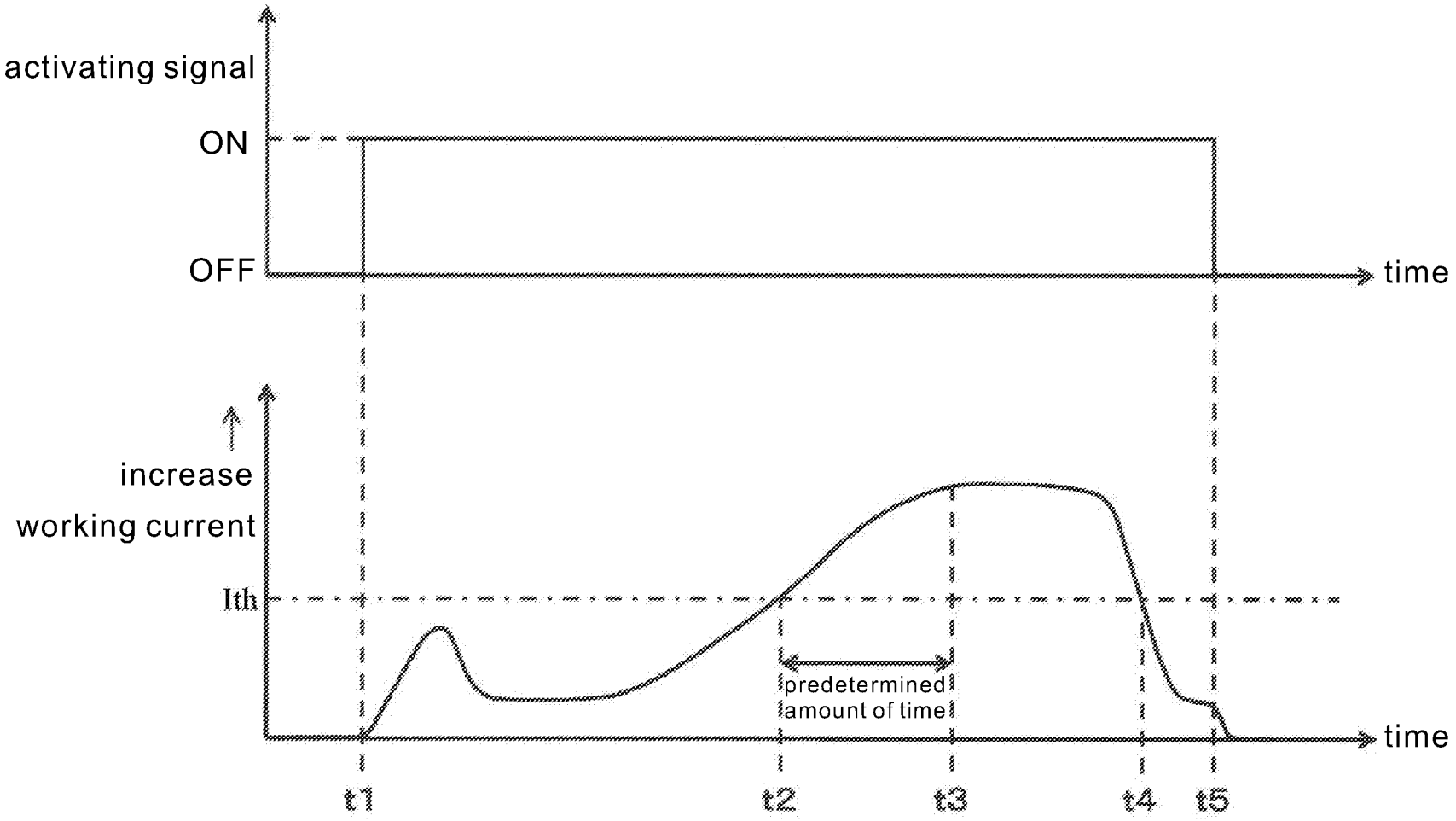
FIG. 21 is a plot of the activating signal generated by the operation switch and the working current supplied to the electric motor during a fastening operation.

FIG. 21 shows an example of the activating signal sent from the operation switch 53 and the current supplied from the battery body 63 to the electric motor 21 in a fastening operation, as explained in more detail below.

At time t1, the operation switch 53 is turned on, and the control unit 110 drives the battery body 63 to supply electric current to the electric motor 21. An inrush current is supplied in the first place to start the electric motor 21. Once the electric motor 21 begins rotating in response to the inrush current supplied, a working current Iw smaller than the inrush current is supplied to the electric motor 21 to keep driving the electric motor 21, thereby screwing the nut 100 onto the fastening portion 101*a* of the shear bolt 101.

When the nut 100 is fastened to the shear bolt 101 to a certain degree, the step of twisting the fragment portion 101*b* off the fastening portion 101*a* begins. The working current Iw is gradually increased and becomes larger than the predetermined current threshold value Ith at time t2 such that the criterion for commencement is satisfied.

Then, the working current Iw stays larger than the predetermined current threshold value Ith and satisfies the criterion for continuation at time t3.

At time t4, with the operation switch 53 in the on state, i.e., with the electric motor 21 in operation, the working current Iw changes from a value greater than the predetermined current threshold value Ith to a value smaller than the predetermined current threshold value Ith such that the criterion for completion is met. Accordingly, the control unit 110 determines that the fastening operation on the nut 100 and the shear bolt 101 is completed.

The operation switch 53 is turned off at time t5; as a result, the control unit 110 stops the electric motor 21 by gradually reducing the working current Iw supplied thereto.

In this embodiment, the control unit 110 can accurately identify the completion of the fastening operation on the nut 100 and the shear bolt 101 because the fastening operation is determined to be completed when the fragment portion 101*b* is twisted off the fastening portion 101*a*.

Furthermore, the count generated by the control unit 110 corresponds to the number of times for which a large current is supplied from the battery body 63 to the electric motor 21; therefore, the remaining power level of the battery body 63 can be accurately known.

In this embodiment, the control unit 110 uses the criterion for commencement and the criterion for completion to determine whether a fastening operation is completed because, if the determination is based solely on the criterion for commencement, a fastening operation in which the fragment portion 101*b* has yet to be twisted off the fastening portion 101*a* may be erroneously determined as completed. By considering the criterion for completion as well as the criterion for commencement, the present invention ensures that the completion of a fastening operation can be accurately identified.

In particular, the criterion for completion specifies that the electric motor 21 should be in operation, so if the working current Iw becomes smaller than the predetermined current threshold value Ith in response to the user turning off the operation switch 53, the control unit 110 will not determine that the criterion for completion is satisfied, let alone determine that the fastening operation is completed. This adds to the accuracy of the identification of the completion of a fastening operation.

In this embodiment, the control unit 110 also uses the criterion for continuation as one of the determination criteria and requires that the criteria be satisfied in a specific order, i.e., the criterion for commencement, the criterion for continuation, and the criterion for completion must be sequentially satisfied. As stated above with reference to FIG. 21, the criterion for commencement is met at time t2, when the working current Iw becomes larger than the predetermined current threshold value Ith; then the criterion for continuation is met at time t3, at least until which the working current Iw has stayed larger than the predetermined current threshold value Ith; and the criterion for completion is met at time t4, when the operation switch 53 remains in the on state and the working current Iw changes from a value greater than the predetermined current threshold value Ith to a value smaller than the predetermined current threshold value Ith. Only when the criteria are sequentially satisfied will the fastening operation be determined as completed. By considering the time it takes for the load applied to the electric motor 21 to increase, the completion of the fastening operation can be identified with enhanced accuracy. Also, the additional condition on temporal sequence allows the remaining power level of the battery body 63 to be accurately determined.

In addition, referring to FIG. 1, FIG. 17, and FIG. 18, the tool body 10 in this embodiment is provided with the display device 90 for displaying the count generated by the control unit 110 so that, based on the count displayed, the user can predict after how many more fastening operations will the remaining power level of the battery body 63 be too low to carry out any fastening operation. This feature helps enhance work efficiency.

Moreover, after determining that the determination criteria are satisfied and that the fastening operation in question is hence completed, the control unit 110 in this embodiment sends a signal to the circuit board 91 to activate the backlight device 93*a* and thereby notify the user that the fastening operation is completed. This feature also helps enhance work efficiency.

In this embodiment, the basis on which the control unit 110 determines whether the fastening operation on the nut 100 and the shear bolt 101 is completed is the value of the working current supplied from the battery body 63 to the electric motor 21 but is not necessarily so. The control unit 110 may instead identify the completion of a fastening operation based on the torque generated by the electric motor 21, wherein the torque is calculated from the value of the working current supplied from the battery body 63 to the electric motor 21. In that case, the "working current" and the "predetermined current threshold value" in the criterion for commencement, the criterion for continuation, and the criterion for completion will be replaced by the "torque" and a "predetermined torque threshold value" respectively.

The control unit 110 may also identify the completion of a fastening operation based on the load applied to the electric motor 21, wherein the load is calculated from the value of the working current supplied from the battery body 63 to the electric motor 21. In that case, the "working current" and the "predetermined current threshold value" in the criterion for commencement, the criterion for continuation, and the criterion for completion will be replaced by the "load" and a "predetermined load threshold value" respectively.

Furthermore, the control unit 110 in this embodiment may be configured to calculate the remaining power level of the battery body 63 from the count of the fastening operations completed, and the electric tool 1 may be provided with a warning device for warning the user in case the remaining power level of the battery body 63 is lower than a predetermined value. For example, the warning device may be a buzzer, an indicator light, or a combination of the above in order to generate a sound, a steady light, a flashing light, or a combination of the above. It is also feasible for the display device 90 to double as the warning device.

In this embodiment, the electric tool 1 may be provided with a buzzer that sounds when a fastening operation is completed. The buzzer may work together with the backlight device 93*a*, or the buzzer may sound without the backlight device 93*a* being activated upon the completion of a fastening operation, or if the fastening operation takes place in a noisy environment, the backlight device 93*a* may be lit without the buzzer being activated.

In this embodiment, the criterion for completion may further include the condition that, after the working current Iw supplied to the electric motor 21 becomes smaller than the predetermined current threshold value Ith, the electric motor 21 should remain in operation for a certain amount of time while the operation switch 53 is in the on state.

Referring to FIG. 4, FIG. 5, FIG. 22, and FIG. 23, the motor section 20 further has a fan 27. The fan 27 works in conjunction with the electric motor 21 in order to cool the electric motor 21. The fan 27 is mounted above the electric motor 21 and is attached to an upper portion of the motor shaft 23 so that when the electric motor 21 begins operation, the fan 27 is rotated along with, and about a rotation axis defined by, the motor shaft 23. The vanes 27*a* of the fan 27 generate a downward cooling airflow when the electric motor 21 rotates in a positive direction (i.e., the direction in which the electric motor 21 rotates to fasten the nut 100 to the shear bolt 101).

In this embodiment, the electric motor 21 is so configured that the motor shaft 23 extends upward in a up and down direction from the electric motor 21, and that the fan 27 is attached to an upper portion of the motor shaft 23. This configuration allows the cooling airflow generated by the fan 27 to flow downward from above the electric motor 21, thereby preventing hot air from accumulating around the electric motor 21, ensuring that the electric motor 21 is effectively cooled. The configuration of the electric motor 21, however, is not limited to the foregoing. The fan 27 may be attached to a lower portion of the motor shaft 23 instead.

Moreover, while the electric tool 1 according to this embodiment is cordless and is powered by the battery 60, it is feasible for the electric tool 1 to dispense with the battery 60 and be powered by a different power source.

In addition, when the step of separating the fragment portion 101*b* from the fastening portion 101*a* begins during a fastening operation, the temperature of the electric motor 21 will rise because the current supplied to the electric motor 21 as well as the load applied to the electric motor 21 is increased. The temperature of the electric motor 21 tends to reach its maximum immediately after the fragment portion 101*b* is separated from the fastening portion 101*a* (i.e., upon completion of the fastening operation). Therefore, when multiple fastening operations are conducted one after another, the electric motor 21 may be overheated, if not damaged, by the heat accumulated therein.

In light of this, the control unit 110 in this embodiment keeps operating the electric motor 21 for a preset amount of time immediately after the fragment portion 101*b* is determined to have been separated from the fastening portion 101*a* (i.e., immediately after the fastening operation is completed), in order to keep the fan 27 in operation. Thus, in the interval between the completion of a fastening operation and the start of the next fastening operation, the electric motor 21 will be cooled by the airflow generated by the fan 27. Even if the fragment portion 101*b* remains in the fragment engaging portion 41 after being separated from the fastening portion 101*a*, the fragment portion 101*b* hardly adds any load to the electric motor 21, meaning the electric motor 21 will be operating in a virtually idle state. Therefore, sustained operation of the electric motor 21 after the fragment portion 101*b* is separated from the fastening portion 101*a* barely increases the temperature of the electric motor 21, not to mention that the electric motor 21 will be properly cooled by the fan 27. It is thus ensured that a plurality of fastening operations can be carried out in succession with the electric motor 21 effectively cooled.

The steps to be performed by the control unit 110 after the completion of a fastening operation are as follows.

Figure 22:
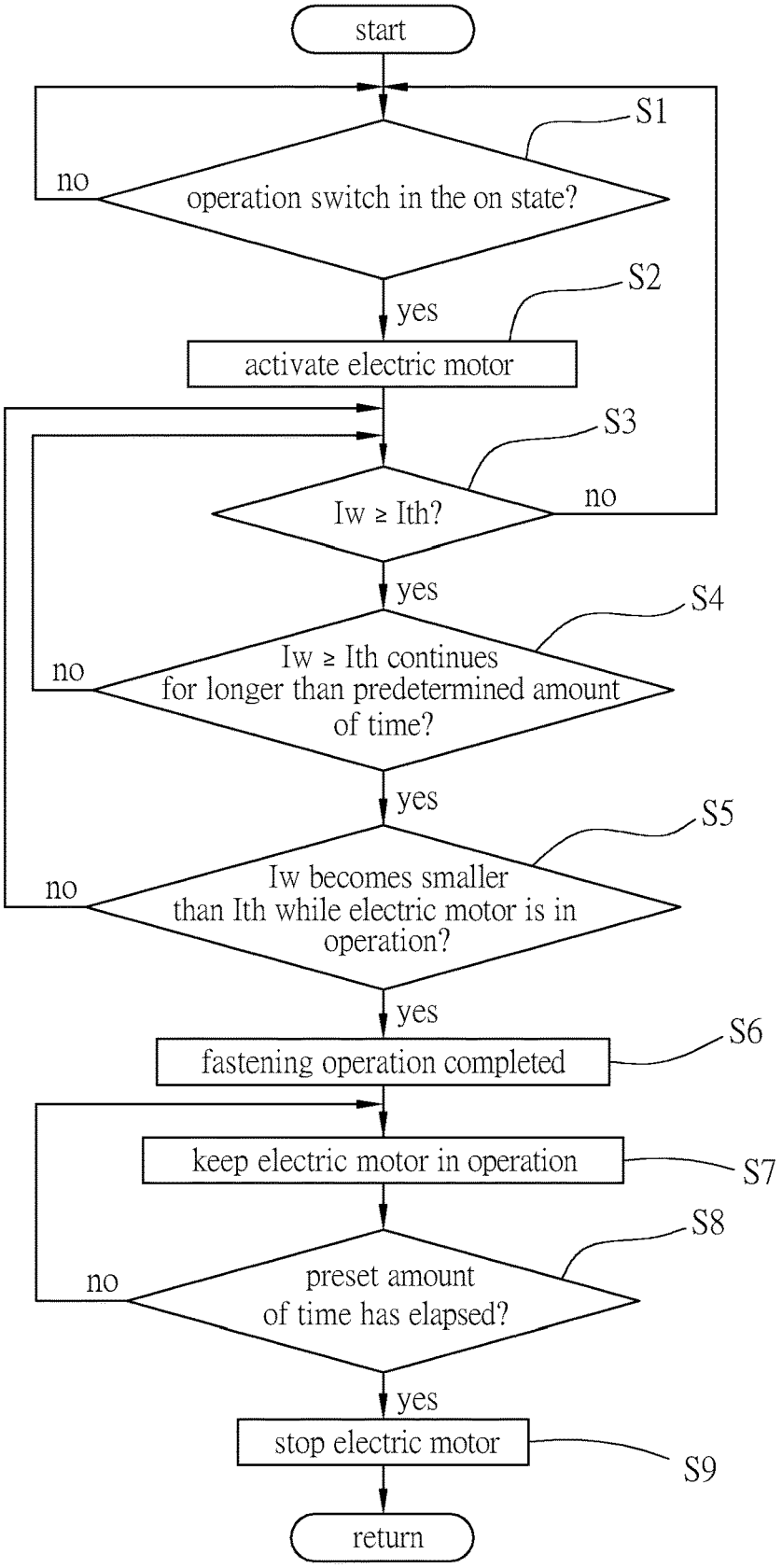
FIG. 22 is a flowchart showing not only the steps to be performed by the control unit of the electric tool in FIG. 1 during a fastening operation, but also the steps to be performed by the control unit to control the fan after the fastening operation.

Referring to FIG. 22, the control unit 110 performs steps S7~S9 after completing the foregoing steps S1~S6. The control unit 110 keeps operating the electric motor 21 for a preset amount of time following the separation of the fragment portion 101*b* from the fastening portion 101*a*, the objective being to keep the fan 27 working during that preset amount of time. In other words, the electric motor 21 is not stopped immediately after the completion of a fastening operation so as to be effectively cooled by the airflow generated by the fan 27. Moreover, the electric tool 1 need not be enlarged to accommodate an additional motor otherwise required for driving the fan 27; that is to say, cooling the electric motor 21 effectively does not necessarily entail an increase in size of the electric tool 1.

Figure 23:
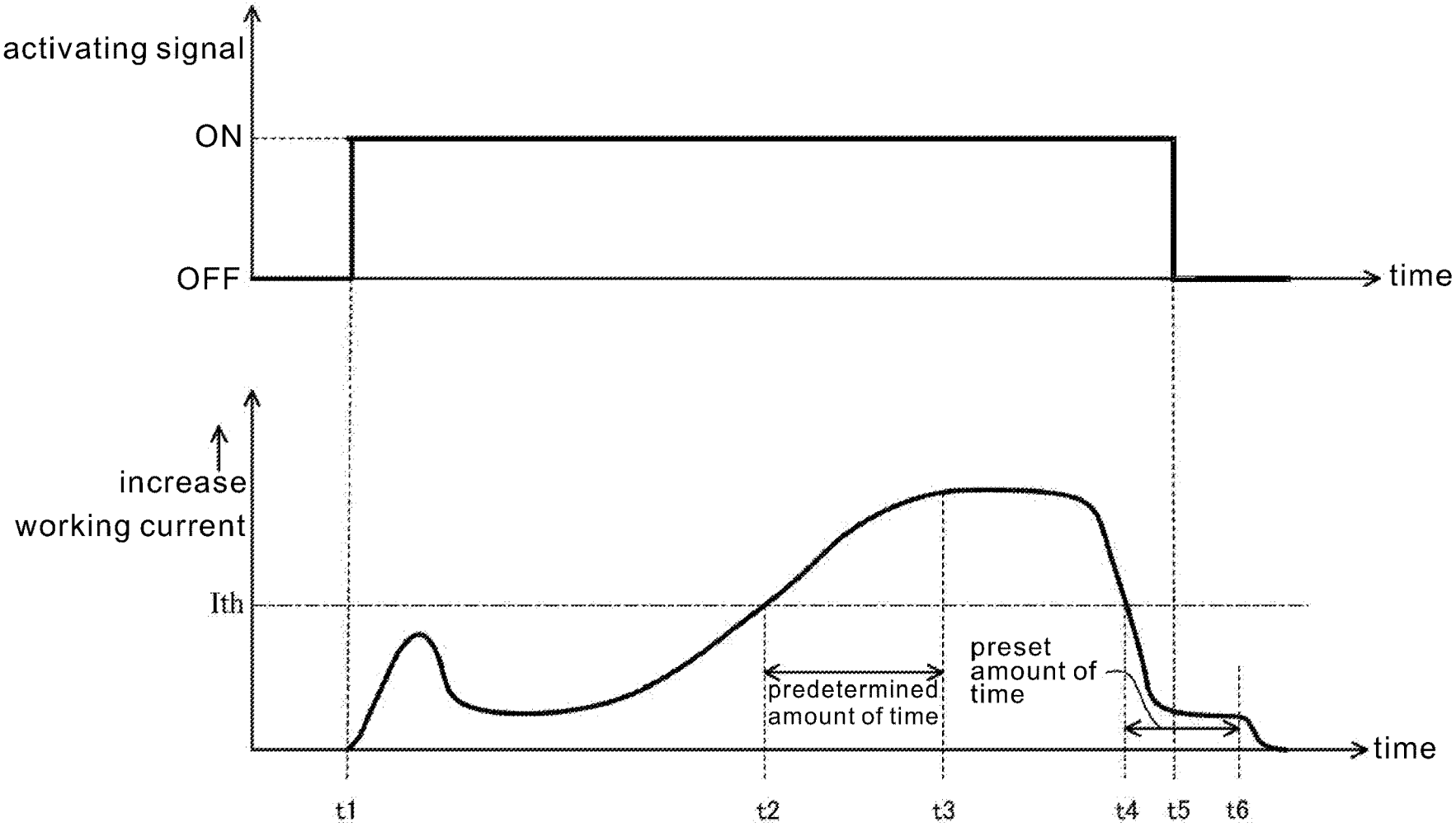
FIG. 23 is a plot of the activating signal generated by the operation switch and the working current supplied to the electric motor during a fastening operation and a following period in which the control unit keeps controlling the fan.

Steps S7~S9 are expounded below with reference to the time axis in FIG. 23. The control unit 110 determines at time t4 that the fastening operation is completed and then continues operating the electric motor 21 for a preset amount of time. Even though the operation switch 53 is turned off at time t5, the control unit 110 keeps operating the electric motor 21 till the end of the preset amount of time, in order for the fan 27 to remain in operation and cool the electric motor 21 during the preset amount of time.

At time t6 (i.e., at the end of the preset amount of time), the control unit 110 stops the electric motor 21 by reducing the working current Iw supplied thereto.

In this embodiment, the preset amount of time (such as but not limited to 1 to 2 seconds) may be manually set or preprogrammed into the control unit 110. For example, the preset amount of time may be set into the control unit 110 by a built-in program according to the time between satisfaction of the criterion for commencement and satisfaction of the criterion for completion (e.g., the preset amount of time being in direct proportion to the time required to complete a fastening operation; i.e., the longer the time required to complete the fastening operation, the longer the preset amount of time set into the control unit 110), or the control unit 110 may set the preset amount of time according to the magnitude of the working current supplied to the electric motor 21 during a fastening operation (e.g., the preset amount of time being in direct proportion to the magnitude of the working current), or the control unit 110 may set the preset amount of time according to a value obtained by integrating the working current supplied to the electric motor 21 during a fastening operation (e.g., the preset amount of time being in direct proportion to the integral of the working current), or the control unit 110 has a temperature sensor (not shown) and sets the preset amount of time according to the temperature sensed by the temperature sensor (e.g., the preset amount of time being in direct proportion to the temperature). All of the aforementioned parameters are associated with the heat generated by the electric motor 21 and therefore can be used to set the preset amount of time, with a view to cooling the electric motor 21 effectively.

The preset amount of time may also be changed by the user as desired. For example, the preset amount of time can be shortened as much as possible if the user wishes to minimize power consumption from the battery body 63.

In this embodiment, it is the control unit 110 that keeps the electric motor 21 working for the preset amount of time as well as determines whether the fragment portion 101*b* is separated from the fastening portion 101*a*.

It is worth mentioning that the electric motor 21 is stopped at time t6 in cases where time t5, at which the user turns off the operation switch 53, precedes time t6, at which the preset amount of time ends. If the user keeps pressing the operation switch 53 not only after the fastening operation is completed, but also after the preset amount of time ends, the electric motor 21 will be stopped immediately after the user releases the operation switch 53.

It can be known from the foregoing that the electric tool disclosed herein is indeed capable of achieving the objective of the present invention.

The electric tool described above, however, is only one embodiment of the present invention and is not intended to be restrictive of the scope of the invention. All equivalent changes and modifications made according to the appended claims and the disclosure of the present specification shall fall within the scope of the invention.

What is claimed is:

1. An electric tool, to be applied to a shear bolt having a fastening portion and a fragment portion, wherein the electric tool twists the fragment portion off the fastening portion after a nut is locked to the fastening portion, the electric tool comprising:

a motor section including an electric motor, the electric motor is configured to generate a rotating force and has a motor shaft, and the motor shaft extends along a direction intersecting a direction of a rotation axis of the shear blot;

a head section disposed above the motor section and having an inner socket for engaging with the fragment portion, the head section is configured to transmit the rotating force of the electric motor to the shear bolt and thereby rotate the shear bolt;

a handle section arranged in tandem with the motor section in a front-rear direction, the handle section extends along an axial direction of the motor shaft and is configured to be gripped by a user;

a coupling section disposed between the motor section and the head section to couple the head section to the motor section in a detachable manner and to allow a pointing direction of a front end of the head section to be changed along a radial direction of the motor shaft;

a battery for providing electricity for driving the electric motor; and a fragment ejecting mechanism for ejecting the fragment portion after the fragment portion is twisted off the fastening portion, the fragment ejecting mechanism has a pushing portion and a driving portion, the pushing portion is disposed in the head section and is configured to push the fragment portion out of the inner socket, and the driving portion is provided at the coupling section and is configured to drive the pushing portion.

2. The electric tool as claimed in claim 1, wherein:

the pushing portion and the driving portion are mechanically linked by a coupling rod extending in a up and down direction;

the coupling section is provided with at least one through hole through which the coupling rod is insertable, and the through hole corresponds in position to the coupling rod after each change of the pointing direction of the front end of the head section;

the pushing portion has:

a fragment rod extending along the direction of the rotation axis and movable between a receiving position and an ejecting position along the direction of the rotation axis, wherein the fragment portion is received in the inner socket when the fragment rod is at the receiving position, and the fragment portion is ejected out of the inner socket when the fragment rod is at the ejecting position;

a first elastic element for applying elastic energy to the fragment rod and thereby driving the fragment rod toward the ejecting position; and a stopper abutting against an upper end of the coupling rod and configured to engage with the fragment rod when the fragment rod is at the receiving portion, thereby preventing the fragment rod from moving toward the ejecting position;

the driving portion has:

a sliding element abutting against a lower end of the coupling rod and having a mechanism whereby the coupling rod is moved in a direction intersecting the direction of the rotation axis when the sliding element is slid; and an operating member for sliding the sliding element; and the fragment ejecting mechanism is such that when the fragment rod is at the receiving position, with the fragment portion inserted in the inner socket, the stopper is engaged with the fragment rod to prevent displacement of the fragment rod, and when the sliding element is slid through operation of the operating member, with the fragment portion remaining in the inner socket, the coupling rod is moved in the direction intersecting the direction of the rotation axis and thereby disengages the fragment rod from the stopper, allowing the fragment rod to be moved to the ejecting position by the elastic energy applied by the first elastic element and thus eject the fragment portion out of the inner socket.

3. The electric tool as claimed in claim 2, wherein:

the fragment rod has an end facing away from the inner socket and provided with a to-be-stopped portion, and the to-be-stopped portion is configured to engage with the stopper;

the stopper is provided with an engaging hole for engaging with the to-be-stopped portion;

the pushing portion further has a second elastic element for applying elastic energy to the stopper and thereby driving the stopper downward in order for the engaging hole to engage with the to-be-stopped portion;

the sliding element is provided with at least one moving mechanism for moving the coupling rod upward against the elastic energy of the second elastic element when the sliding element is slid; and the moving mechanism corresponds in position to the coupling rod after said change of the pointing direction of the front end of the head section.

4. The electric tool as claimed in claim 3, wherein:

the moving mechanism is at least one sliding-element engaging portion provided at the sliding element to engage with the lower end of the coupling rod; and when the sliding element is slid, the lower end of the coupling rod leaves the sliding-element engaging portion and is moved onto a surface of the sliding element such that the coupling rod is moved upward.

5. The electric tool as claimed in claim 4, wherein the sliding-element engaging portion forms one of a hole and a groove.

6. The electric tool as claimed in claim 4, wherein:

the sliding-element engaging portion has a tapered periphery, and the tapered periphery has a diameter that is gradually reduced downward; and the lower end of the coupling rod has a tapered periphery matching the tapered periphery of the sliding-element engaging portion.

7. The electric tool as claimed in claim 4, wherein:

the sliding-element engaging portion has a concave spherical periphery; and the lower end of the coupling rod has a hemispherical periphery matching the concave spherical periphery of the sliding-element engaging portion.

8. The electric tool as claimed in claim 2, wherein the coupling section is provide with a C-shaped through hole.

9. The electric tool as claimed in claim 3, wherein:

the sliding element is cross-shaped when viewed in the axial direction of the motor shaft and has four arms extending forward, rearward, leftward, and rightward respectively;

the sliding element is provided with a plurality of said moving mechanisms, the moving mechanisms are located at the front, rear, left and right ends of the sliding member respectively; and the coupling section is provided with a plurality of said through holes, the through holes corresponding in position to the moving mechanisms respectively.

10. The electric tool as claimed in claim 1, wherein the head section is configured to be affixed to the coupling section to assume any position selected from the group consisting of: a forward-facing position, where the front end of the head section points forward; a rearward-facing position, where the front end of the head section points rearward; a leftward-facing position, where the front end of the head section points leftward such that the rotation axis is perpendicular to the front-rear direction; and a rightward-facing position, where the front end of the head section points rightward such that the rotation axis is perpendicular to the front-rear direction.

11. The electric tool as claimed in claim 1, further comprising a tool body, wherein:

the electric motor is disposed in the tool body;

the head section is disposed at the tool body;

the handle section is disposed at the tool body, and is below the head section, and has a grip area to be grasped by the user's hand;

the battery is disposed below the handle portion; and the tool body is provided with a display device in an upper portion of the handle section, wherein the display device is configured to display information about a fastening operation on the nut and the shear bolt.

12. The electric tool as claimed in claim 11, wherein the side where the inner socket located in the head section is defined a front side of the tool body, the display device is a rear side of the tool body, the handle section has a rear end located rearward of a rear end of the head section, the handle section has an upper end upwardly extended with an upwardly extending mounting portion, and the display device is mounted in the upwardly extending mounting portion.

13. The electric tool as claimed in claim 11, wherein the information displayed by the display device comprises one or a combination selected from the group consisting of: the number of said shear bolts that have been fastened, a load applied to the electric motor when the shear bolt is fastened, and a remaining power level of the battery.

14. The electric tool as claimed in claim 11, wherein the display device includes a warning device, and the warning device is one or a combination selected from the group consisting of a buzzer and a light.

15. The electric tool as claimed in claim 1, further comprising:

a determination section for determining whether a fastening operation on the nut and the shear bolt is completed, wherein the determination section determines the fastening operation to be completed when the fragment portion is twisted off the fastening portion; and a counting section for counting said fastening operations that are determined by the determination section to be completed.

16. The electric tool as claimed in claim 15, wherein the determination section has a criterion for commencement and a criterion for completion as criteria by which to determine whether the fastening operation on the nut and the shear bolt is completed, the criterion for commencement is that a working current supplied from the battery to the electric motor is larger than a predetermined current threshold value, and the criterion for completion is that the working current changes from a value greater than the predetermined current threshold value to a value smaller than the predetermined current threshold value while the electric motor is in operation.

17. The electric tool as claimed in claim 16, wherein the determination section further has a criterion for continuation as a criterion by which to determine whether the fastening operation on the nut and the shear bolt is completed, the criterion for continuation is that the working current stays larger than the predetermined current threshold value at least for a predetermined amount of time, and the determination section regards the fragment portion as twisted off the fastening portion, and hence determines that the fastening operation on the nut and the shear bolt is completed, when the criterion for commencement, the criterion for continuation, and the criterion for completion are sequentially satisfied in the above-stated order.

18. The electric tool as claimed in claim 1, further comprising a tool body, a control unit, and a fan configured to work in conjunction with the electric motor, wherein:

the electric motor is disposed in the tool body; and the control unit is configured to operate and control the electric motor, is set with a preset amount of time for which to keep the electric motor in operation, and keeps the fan in operation for the preset amount of time after the fragment portion is twisted off the fastening portion, in order for the fan to cool the electric motor.

19. The electric tool as claimed in claim 18, further comprising a determination section for determining whether a fastening operation on the nut and the shear bolt is completed, wherein the determination section determines the fastening operation to be completed when the fragment portion is twisted off the fastening portion, the determination section has a criterion for commencement and a criterion for completion as criteria by which to determine whether the fastening operation is completed, the criterion for commencement is that a working current supplied from the battery to the electric motor is larger than a predetermined current threshold value, the criterion for completion is that the working current changes from a value greater than the predetermined current threshold value to a value smaller than the predetermined current threshold value while the electric motor is in operation; and the control unit keeps the electric motor in operation after the determination section determines that the fragment portion is twisted off the fastening portion, in order to keep the fan in operation for the preset amount of time.

20. The electric tool as claimed in claim 19, wherein the control unit sets the preset amount of time according to a time between satisfaction of the criterion for commencement and satisfaction of the criterion for completion.

21. The electric tool as claimed in claim 19, wherein the control unit sets the preset amount of time according to the magnitude of the working current supplied to the electric motor during the fastening operation.

22. The electric tool as claimed in claim 19, wherein the control unit has a temperature sensor and sets the preset amount of time according to a temperature sensed by the temperature sensor.

23. The electric tool as claimed in claim 18, wherein the motor shaft extends upward in a up and down direction, and the fan is attached to an upper portion of the motor shaft.

* * * * *